US007231345B2

(12) United States Patent
Murashima

(10) Patent No.: US 7,231,345 B2
(45) Date of Patent: Jun. 12, 2007

(54) METHOD AND APPARATUS FOR TRANSCODING BETWEEN DIFFERENT SPEECH ENCODING/DECODING SYSTEMS

(75) Inventor: Atsushi Murashima, Tokyo (JP)

(73) Assignee: NEC Corporation (JP)

( * ) Notice: Subject to any disclaimer, the term of this patent is extended or adjusted under 35 U.S.C. 154(b) by 120 days.

(21) Appl. No.: 11/039,969

(22) Filed: Jan. 24, 2005

(65) Prior Publication Data

US 2005/0131682 A1 Jun. 16, 2005

Related U.S. Application Data

(63) Continuation of application No. PCT/JP03/008701, filed on Jul. 9, 2003.

(30) Foreign Application Priority Data

Jul. 24, 2002 (JP) ..... 2002-215766

(51) Int. Cl.
*G10L 19/12* (2006.01)

(52) U.S. Cl. ..... 704/219

(58) Field of Classification Search ..... None
See application file for complete search history.

(56) References Cited

U.S. PATENT DOCUMENTS 5,091,945 A * 2/1992 Kleijn ..... 704/219
6,240,385 B1 * 5/2001 Foodeei ..... 704/220
6,678,654 B2 * 1/2004 Zinser et al. ..... 704/221

FOREIGN PATENT DOCUMENTS

JP 08-146997 A 6/1996
JP 10-207491 A 8/1998
JP 2002-198870 A 7/2002

OTHER PUBLICATIONS

International Search Report (with English Language Translation) for Parent PCT Application PCT/JP2003/008701.

(Continued)

*Primary Examiner*—Susan McFadden
(74) *Attorney, Agent, or Firm*—Dickstein, Shapiro, LLP.

(57) ABSTRACT

A code converting apparatus for converting a first code sequence conforming to a first system to a second code sequence conforming to a second system, in which a speech decoding circuit acquires a first linear prediction coefficient and the information on an excitation signal from the first code sequence, and actuates a filter having the aforementioned first linear prediction coefficient with the excitation signal obtained from the information on the excitation signal, to generate a first speech signal. A gain code generating circuit calculates a gain minimizing the distance between a second speech signal, generated from the information, obtained from the second code sequence, and the first speech signal (optimum gain), and corrects the optimum gain and the gain code generating circuit then finds the gain information in the second code sequence, based on the optimum gain as corrected (optimum gain corrected), the above optimum gain and a gain read out from a gain codebook of the second system. The gain is found at this time, in a non-speech segment, based on a speech decision value, using an evaluation function which will reduce time variations of the gain of the second system.

22 Claims, 12 Drawing Sheets

OTHER PUBLICATIONS

Manfred R. Schroeder, et al.; "Code-Excited Linear Prediction (CELP): High-Quality Speech at Very Low Bit Rates"; Proc. of IEEE Int. Conf. on Acoustics, Speech and Signal Processing; 1985; pp. 937-940.

Hong-Goo Kang, et al; "Improving Transcoding Capability of Speech Coders in Clean and Frame Erased Channel Environments"; Proc. of IEEE Workshop on Speech Coding 2000; 2000; pp. 78-80.

"3GPP AMR Speech Codec"; 3GPP TS 26.090 V4.0.0 (Mar. 2001); pp. 19-44.

* cited by examiner

METHOD AND APPARATUS FOR TRANSCODING BETWEEN DIFFERENT SPEECH ENCODING/DECODING SYSTEMS

CROSS-REFERENCE TO RELATED APPLICATIONS

This application is a continuation of International Application No. PCT/JP2003/008701, filed on 09 Jul. 2003, and claims priority to Japanese Patent Application No. 2002-215766, filed on 24 Jul. 2002, both of which are incorporated herein by reference in their entireties.

TECHNICAL FIELD

This invention relates to encoding and decoding methods for transmitting or storing a speech signal at a low bit rate. More particularly, it relates to a method and an apparatus, used in speech communication employing different encoding/decoding systems, for converting codes obtained on encoding the speech by a given system, into codes which can be decoded by another system, with a high sound quality and reduced computation quantity.

BACKGROUND ART

As a method for encoding a speech signal at low or medium bit rates with high efficiency, there has so far been extensively used a method which separates and encodes the speech signal into linear prediction (LP) coefficients and an excitation signal for driving an LP filter. As typical of such method is code excited linear prediction (CELP). In the CELP, an LP filter, in which the LP coefficients, representing frequency response of the input speech, is driven by an excitation signal represented by the sum of an adaptive codebook (ACB) representing the pitch period of the input speech and a fixed codebook (FCB) composed of random numbers and pulses to generate a synthesized speech signal. The ACB and FCB components are multiplied by gains (ACB gain and FCB gain). As for CELP, reference may be had to M. Schroeder and B. S. Atal: "Code Excited Linear Prediction: High Quality Speech at very low Rates," Proc. of IEEE Int. Conf. on Acoustics., Speech and Signal Processing, pp. 937 to 940, 1985 (Publication 1).

If the interconnection between a 3G mobile network and a wired packet network is supposed to be implemented, there is raised a problem that direct connection is not possible because of the difference in the standard speech encoding systems used in the respective networks. The simplest solution for this is tandem connection. However, in the tandem connection, speech signals are transiently decoded from a code sequence, obtained on encoding the speech, using one of the standard systems, by this one standard system, and the speech signals, thus decoded, are re-encoded using the other standard system. As a result, there are raised such problems as lowered speech quality, increased delay and increased computation quantity as compared to a case where encoding and decoding are carried out only once in each of the speech encoding/decoding systems.

These problems may effectively be addressed by a transcoding system in which a code obtained on encoding the speech using one of the standard systems into a code decodable using the other standard system in a code domain or in an encoding parameter domain. As for the code converting method, reference may be had to Hong-Goo Kang: "Improving Transcoding Capability of Speech Coders in Clean and Frame Erased Channel Environments," Proc. of IEEE Workshop on Speech Coding 2000, pp. 78 to 80, 2000 (Publication 2).

FIG. 12 shows an illustrative configuration of a transcoder which converts a code, obtained on encoding the speech using a first speech encoding system (system A) into a code decodable by a second code (system B). Referring to FIG. 12, the transcoder includes an input terminal 10, a code demultiplexing circuit 1010, an LP coefficient code converting circuit 100, an ACB code converting circuit 200, an FCB code converting circuit 300, a gain code converting circuit 400, a code multiplexing circuit 1020 and an output terminal 20. Referring to FIG. 12, the component elements of the conventional transcoder are described.

A first code sequence, obtained on encoding the speech in accordance with the system A, is entered to the input terminal 10.

The code demultiplexing circuit 1010 separates codes corresponding to the LP coefficient, ACB, FCB, ACB gain and FCB gain, that is, LP coefficient code, ACB code, FCB code and the gain code, from the first code sequence, entered to the input terminal 10. The ACB gain and the FCB gain are collectively encoded/decoded and are termed the gains, for simplicity sake. The corresponding codes are termed gain codes. The LP coefficient code, ACB code, FCB code and the gain code are termed first LP coefficient code, first ACB code, first FCB code and the first gain code, respectively. The first LP coefficient codes, first ACB codes, first FCB codes and the first gain code are output to the LP coefficient code converting circuit 100, an ACB code converting circuit 200, an FCB code converting circuit 300 and to the gain code converting circuit 400, respectively.

The LP coefficient code converting circuit 100 is supplied with the first LP coefficient codes, output from the code demultiplexing circuit 1010, to convert the first LP coefficient codes into codes decodable by the system B. The so converted LP coefficient codes are output as the second LP coefficient codes to the code multiplexing circuit 1020.

The ACB code converting circuit 200 is supplied with the first ACB code, output from the code demultiplexing circuit 1010, to convert the first ACB code into a code decodable by the system B. The so converted ACB code is supplied as the second ACB code to the code multiplexing circuit 1020.

The FCB code converting circuit 300 is supplied with the first FCB code, output from the code demultiplexing circuit 1010, to convert the first FCB code into a code decodable by the system B. The so converted FCB code is supplied as the second FCB code to the code multiplexing circuit 1020.

The gain code converting circuit 400 is supplied with the first gain codes, output from the code demultiplexing circuit 1010, to convert the first gain code into code decodable by the system B. The so converted gain code is supplied as the second gain code to the code multiplexing circuit 1020.

More specified operations of the code converting circuits are hereinafter explained The LP coefficient code converting circuit 100 decodes the first LP coefficient code, entered from the code demultiplexing circuit 1010, by an LP coefficient decoding method in the system A to produce first LP coefficient. The LP coefficient code converting circuit 100 quantizes and encodes the first LP coefficient, in accordance with the quantization method and the encoding method for the LP coefficient by the system B, to yield second LP coefficient code. The LP coefficient code converting circuit 100 outputs the second LP coefficient code to the code multiplexing circuit 1020, as the code decodable by the LP coefficient decoding method by the system B.

The ACB code converting circuit 200 translates the first ACB code, entered from the code demultiplexing circuit 1010, using the relationship of correspondence between the code of the system A and that of the system B, to derive the second ACB code. The ACB code converting circuit 200 outputs the second ACB code to the code multiplexing circuit 1020 as the code decodable by the ACB decoding method in the system B.

The FCB code converting circuit 300 translates the first FCB code, entered from the code demultiplexing circuit 1010, using the relationship of correspondence between the code of the system A and that of the system B, to derive the second FCB code. The FCB code converting circuit 300 outputs the second FCB code to the code multiplexing circuit 1020 as the code decodable by the FCB decoding method in the system B.

The gain code converting circuit 400 decodes the first gain code, supplied from the code demultiplexing circuit 1010, using the gain decoding method of the system A, to produce the first gain. The gain code converting circuit 400 then quantizes and encodes the first gain in accordance with the gain quantization method and the gain encoding method of the system B to derive the second gain and its code (second gain code). The gain code converting circuit 400 then outputs the second gain code as the code decodable by the gain decoding method of the system B to the code multiplexing circuit 1020.

The code multiplexing circuit 1020 is supplied with the second LP coefficient code, output from the LP coefficient code converting circuit 100, the second ACB code, output from the ACB code converting circuit 200, the second FCB code, output from the FCB code converting circuit 300 and the second gain code, output from the gain code converting circuit 400, to output a code sequence, obtained on multiplexing these codes, as a second code sequence to the output terminal 20. The above is the description of FIG. 12.

However, the conventional transcoder, explained above with reference to FIG. 12, suffers from the problem that the sound quality of the background noise energy for the non-speech period is deteriorated.

The reason is that the temporal variation of the background noise energy during the non-speech period are large because of severe temporal changes during the non-speech period of the second gain obtained on re-quantization of the first gain.

Accordingly, it is an object of the present invention to provide a method and an apparatus whereby the deterioration of the sound quality of the background noise during the non-speech period may be reduced, and a recording medium having a corresponding program recorded thereon. Other objects, features and advantages of the present invention will be apparent from the following description.

SUMMARY OF THE DISCLOSURE

The above and other objects are attained by the present invention which provides, in one aspect, a code converting method for converting a first code sequence conforming to a first system to a second code sequence conforming to a second system, comprising the steps of acquiring first linear prediction coefficient and the information on an excitation signal from the first code sequence and actuating a filter having the first linear prediction coefficient with the excitation signal obtained from the information on the excitation signal to generate a first speech signal, deriving an optimum gain based on a second speech signal generated by the information obtained from a second code sequence, and on the first speech signal, correcting the optimum gain, and finding the gain information in the second code sequence based on an optimum gain corrected (corrected optimum gain), the optimum gain and on the gain read out from a gain codebook for the second system. In the method of the present invention, the optimum gain is preferably found as a gain which minimizes the distance between the second speech signal, generated from the second code sequence, and the aforementioned first speech signal.

The present invention provides, in its second aspect, a code converting method for converting a first code sequence conforming to a first system to a second code sequence conforming to a second system, comprising the steps of decoding the gain information from the first code sequence, correcting the gain decoded (decoded gain), and finding the gain information in the code sequence based on the decoding gain corrected (corrected decoded gain), the decoded gain and the gain read out from the codebook in the second system.

In the invention of the second aspect, preferably a first square error is calculated from the corrected optimum gain and from the gain read out from the gain codebook, a second square error is calculated from the optimum gain and from the gain read out from the gain codebook, and a gain minimizing an evaluation function which is based on the first square error and the second square error from the gain codebook is selected to find the gain information in the second code sequence.

In the invention of the second aspect, preferably a first square error is calculated from the corrected decoded gain and from the gain read out from the gain codebook, a second square error is calculated from the de coded gain and from the gain read out from the gain codebook, and a gain minimizing an evaluation function which is based on the first square error and the second square error from the gain codebook is selected to find the gain information in the second code sequence.

In the invention of the first aspect, preferably the corrected optimum gain is based on the long-term average value of the optimum gain.

In the invention of the second aspect, preferably corrected decoded gain is based on the long-term average value of the decoded gain.

The present invention also provides, in its third aspect, a transcoder for converting a first code sequence conforming to a first system to a second code sequence conforming to a second system, comprising a speech decoding circuit for acquiring first linear prediction coefficient and the information on an excitation signal from the first code sequence and actuating a filter having the first linear prediction coefficient with the excitation signal obtained from the information on the excitation signal to generate a first speech signal, an optimum gain calculating circuit for calculating an optimum gain based on a second speech signal generated by the information obtained from a second code sequence, and on the first speech signal, an optimum gain correcting circuit for correcting the optimum gain, and a gain encoding circuit for finding the gain information in the second code sequence based on an optimum gain corrected (corrected optimum gain), the optimum gain and on the gain read out from a gain codebook for the second system. In the apparatus of the present invention, the optimum gain is preferably found as a gain which minimizes the distance between the second speech signal, generated from the second code sequence, and the aforementioned first speech signal.

The present invention also provides, in its fourth aspect, a code converting apparatus (transcoder) for converting a first code sequence conforming to a first system to a second code sequence conforming to a second system, comprising a gain decoding circuit for decoding the gain information from the first code sequence, a decoded gain correcting circuit for correcting the gain decoded (decoded gain), and a gain encoding circuit for finding the gain information in the code sequence based on the decoding gain corrected (corrected decoded gain), the decoded gain and the gain read out from the codebook in the second system.

In the invention of the third aspect, the gain encoding circuit preferably finds the gain information in the second code sequence by calculating a first square error from the corrected optimum gain and from the gain read out from the gain codebook, calculates a second square error from the optimum gain and from the gain read out from the gain codebook, and selects a gain minimizing an evaluation function which is based on the first square error and the second square error from the gain codebook to find the gain information in the second code sequence.

In the invention of the fourth aspect, the gain encoding circuit preferably calculates a first square error from the corrected decoded gain and from the gain read out from the gain codebook, calculates a second square error from the decoded gain and from the gain read out from the gain codebook, and selects a gain minimizing an evaluation function which is based on the first square error and the second square error from the gain codebook to find the gain information in the second cod sequence.

In the optimum gain correcting circuit of the invention of the third aspect, the corrected optimum gain is preferably based on the long-term average value of the optimum gain.

In the decoded gain correcting circuit of the invention of the fourth aspect, the corrected decoded gain is preferably based on the long-term average value of the decoded gain.

The present invention also provides, in its fifth aspect, a program for having a computer, forming a code converting apparatus (transcoder) for converting a first code sequence, conforming to a first system, into a second code sequence conforming to a second system, exe cute (a) the processing of acquiring first linear prediction coefficient and the information on an excitation signal from the first code sequence and actuating a filter having the first linear prediction coefficient with the excitation signal obtained from the information on the excitation signal to generate a first speech signal, (b) the processing of calculating an optimum gain based on a second speech signal generated by the information obtained from a second code sequence, and on the first speech signal, (c) the processing of correcting the optimum gain, and (d) the processing of finding the gain information in the second code sequence based on an optimum gain corrected (corrected optimum gain), the optimum gain and on the gain read out from a gain codebook for the second system. In the present invention, the gain which minimized the distance between the second speech signal obtained from the second code sequence and the aforementioned first speech signal is found as the optimum gain. In the present invention, the gain which minimizes the distance between the second speech signal generated from the second code sequence and the aforementioned first speech signal is found as the optimum gain.

The present invention provides, in its sixth aspect, a program for having a computer, forming a transcoder for converting a first code sequence conforming to a first system, into a second code sequence conforming to a second system, execute (a) the processing of decoding the gain information from the first code sequence;

(b) the processing of correcting the gain decoded (decoded gain); and (c) the processing of finding the gain information in the code sequence based on the decoding gain corrected (corrected decoded gain), the decoded gain and the gain read out from the codebook in the second system.

In the program of the invention of the sixth aspect, preferably a first square error is calculated from the corrected optimum gain and from the gain read out from the gain codebook, a second square error is calculated from the optimum gain and from the gain read out from the gain codebook, and a gain minimizing an evaluation function which is based on the first square error and the second square error is selected from the gain codebook to find the gain information in the second code sequence.

In the program of the invention of the sixth aspect, preferably a first square error is calculated from the corrected decoded gain and from the gain read out from the gain codebook, a second square error is calculated from the decoded gain and from the gain read out from the gain codebook, and a gain minimizing an evaluation function which is based on the first square error and the second square error is selected from the gain codebook to find the gain information in the second code sequence.

In the program of the invention of the fifth aspect, the corrected optimum gain is based on a long-term average value of the optimum gain.

In the program of the invention of the sixth aspect, the corrected decoded gain is based on a long-term average value of the optimum gain.

The present invention also provides, in its seventh aspect, a recording medium having recorded thereon the program according to the fifth and sixth aspects of the present invention.

Still other objects and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing an description are to be regarded as illustrative in nature, and not as restrictive.

PREFERRED EMBODIMENTS OF THE INVENTION

In the following, preferred embodiments of the present invention are described. First, the schematics and the principle of the apparatus and the method of the present invention are described, and the embodiments are then described in detail.

In the transcoder according to the present invention, a speech decoding circuit (1500) obtains the information of first linear prediction coefficient and an excitation signal from the first code sequence, conforming to the first system, and actuates a filter, having the aforementioned first linear prediction coefficient, with the excitation signal obtained from the information of the excitation signal, to generate a first speech signal. A gain code generating circuit (1400) calculates a second speech signal, generated from the information obtained from the second code sequence conforming to the second system, and the gain minimizing the distance from the first speech signal (optimum gain), and corrects the optimum gain to find the gain information in the second code sequence based on the gain read out from the gain codebook in the second system.

The method of the present invention has the following steps:

step a: the first linear prediction coefficient is obtained from the first code sequence;

step b: the information on the excitation signal is obtained from the first code sequence;

step c: the excitation signal is obtained from the information on the excitation signal;

step d: the filter having the first linear prediction coefficient is actuated by the excitation signal to generate a first speech signal;

step e: the gain minimizing the distance between the second speech signal, generated by the information obtained from the first linear prediction coefficient, and the aforementioned first speech signal (optimum signal), is calculated;

step f: the aforementioned optimum gain is corrected; and step g: the gain information in the second code sequence is found, based on the optimum gain as corrected (corrected optimum gain), the aforementioned optimum gain, and the gain read out from the gain codebook of the second system.

According to the present invention, the aforementioned second gain is found, in the non-speech period, using an evaluation function which will minimize the temporal variation of the second gain (gain in the second code sequence).

Consequently, the temporal variation of the second gain produced become small in the aforementioned non-speech period, with the time variation of the background noise energy becoming smaller.

The result is that the deterioration of the sound quality of the background noise in the non-speech segment may be diminished.

Preferred embodiments of the present invention are now described in detail with reference to the drawings.

First Embodiment

Figure 1:
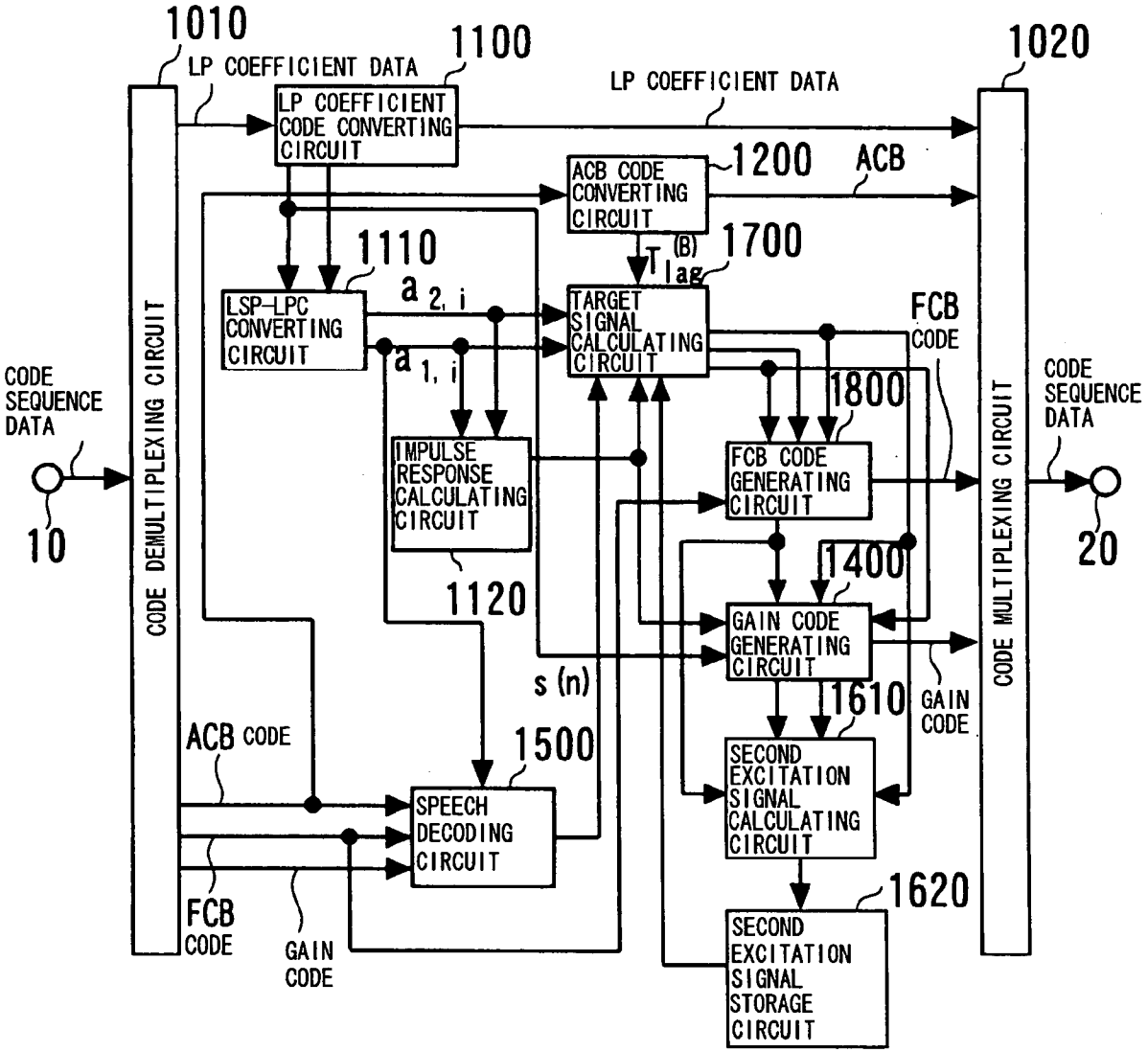
FIG. 1 is a diagram showing the configuration of a first embodiment of a transcoder according to the present invention.
Figure 12:
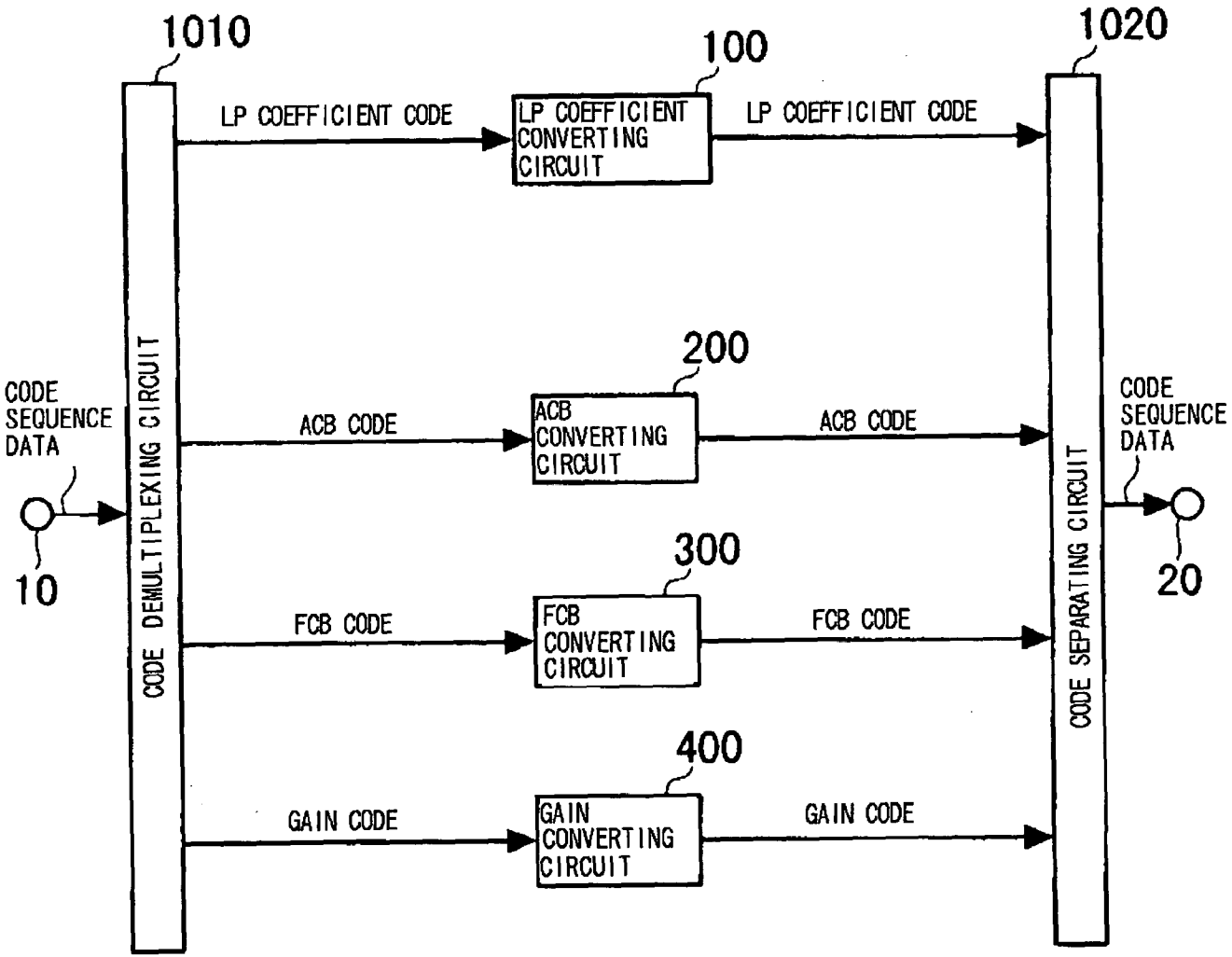
FIG. 12 PRIOR ART
FIG. 12 is a diagram showing the configuration of a conventional transcoder.

FIG. 1 shows the configuration of a first embodiment of the transcoder according to the present invention. In FIG. 1, parts or components which are the same as those of FIG. 12 are depicted by the same reference numerals. Referring to FIG. 1, the first embodiment of the transcoder includes an input terminal 10, a code demultiplexing circuit 1010, an LP coefficient code converting circuit 1100, an LSP to LPC converting circuit 1110, an impulse response calculating circuit 1120, an ACB code converting circuit 1200, a target signal calculating circuit 1700, an FCB code generating circuit 1800, a gain code generating circuit 1400, a speech decoding circuit 1500, a second excitation signal calculating circuit 1610, a second excitation signal storage circuit 1620, a code multiplexing circuit 1020 and an output terminal 20. The input terminal 10, output terminal 20, code demultiplexing circuit 1010 and the code multiplexing circuit 1020 are basically the same elements as the elements shown in FIG. 12, except that interconnections are partially branched. In the following, these same or equivalent elements are omitted from explanation, and mainly the point of difference from the configuration shown in FIG. 12 is described.

It is assumed that, in the system A, the LP coefficients are encoded every $T_{fy}^{(A)}$ msec (from one frame to the next), while constituent elements of the excitation signal, such as ACB, FCB and gain, are encoded every $T_{sfy}^{(A)}=T_{fy}^{(A)}/N_{sfy}^{(A)}$ msec (from one sub-frame to the next).

On the other hand, it is assumed that, in the system B, the LP coefficients are encoded every $T_{fy}^{(B)}$ msec (from one frame to the next), while constituent elements of the excitation signal are encoded every $T_{sfy}^{(B)}=T_{fy}^{(B)}/N_{sfy}^{(B)}$ msec (from one sub-frame to the next).

It is also assumed that the frame length, number of sub-frames and the sub-frame length of the system A are $L_{fy}^{(A)}$, $N_{sfy}^{(A)}$ and $L_{sfy}^{(A)}=L_{fy}^{(A)}/N_{sfy}^{(A)}$, respectively.

It is also assumed that the frame length, number of sub-frames and the sub-frame length of the system B are, $L_{fy}^{(B)}$, $N_{sfy}^{(B)}$ and $L_{sfy}^{(B)}=L_{fy}^{(B)}/N_{sfy}^{(B)}$, respectively.

In the following explanation, it is assumed, for simplicity sake, that $$L_{fy}^{(A)}=L_{fy}^{(B)}$$

$$N_{sfy}^{(A)}=N_{sfy}^{(B)}=2$$

If it is assumed that, for example, the sampling frequency is 8000 Hz and that $T_{fy}^{(A)}$ and $T_{fy}^{(B)}$ are 10 msec, $L_{fy}^{(A)}$ and $L_{fy}^{(B)}$ are 160 samples, while $L_{sfy}^{(A)}$ and $L_{sfy}^{(B)}$ are 80 samples.

The LP coefficient code converting circuit 1100 is supplied from the code demultiplexing circuit 1010 with the first LP coefficient code. It is noted that, in many standard systems, including '3GPP AMR Speech Codec' (Publication 3) and ITU-T recommendations G.729, the LP coefficient is represented by a line spectral pair (LSP), which LSP is encoded and decoded, and hence it is assumed that encoding and decoding of the LP coefficient is carried out in an LSP domain. As regards the conversion from the LP coefficient to LSP and from LSP to LP coefficient, reference may be had to known methods, such as are described in 'Publication 3' paragraphs 5.2.3 and 5.2.5. The LP coefficient code converting circuit 1100 decodes the aforementioned first LP coefficient code by the LSP decoding method in the system A to yield a first LSP.

The LP coefficient code converting circuit 1100 quantizes and encodes the first LSP by the LSP quantizing and encoding methods of the system B to yield a second LSP and a corresponding code (second LP coefficient code). The LP coefficient code converting circuit 1100 outputs the second LP coefficient code to the code multiplexing circuit 1020, as the code decodable by the LSP decoding method of the system B, and outputs the frit LSP and the second LSP to the LSP-to-LPC converting circuit 1110.

Figure 2:
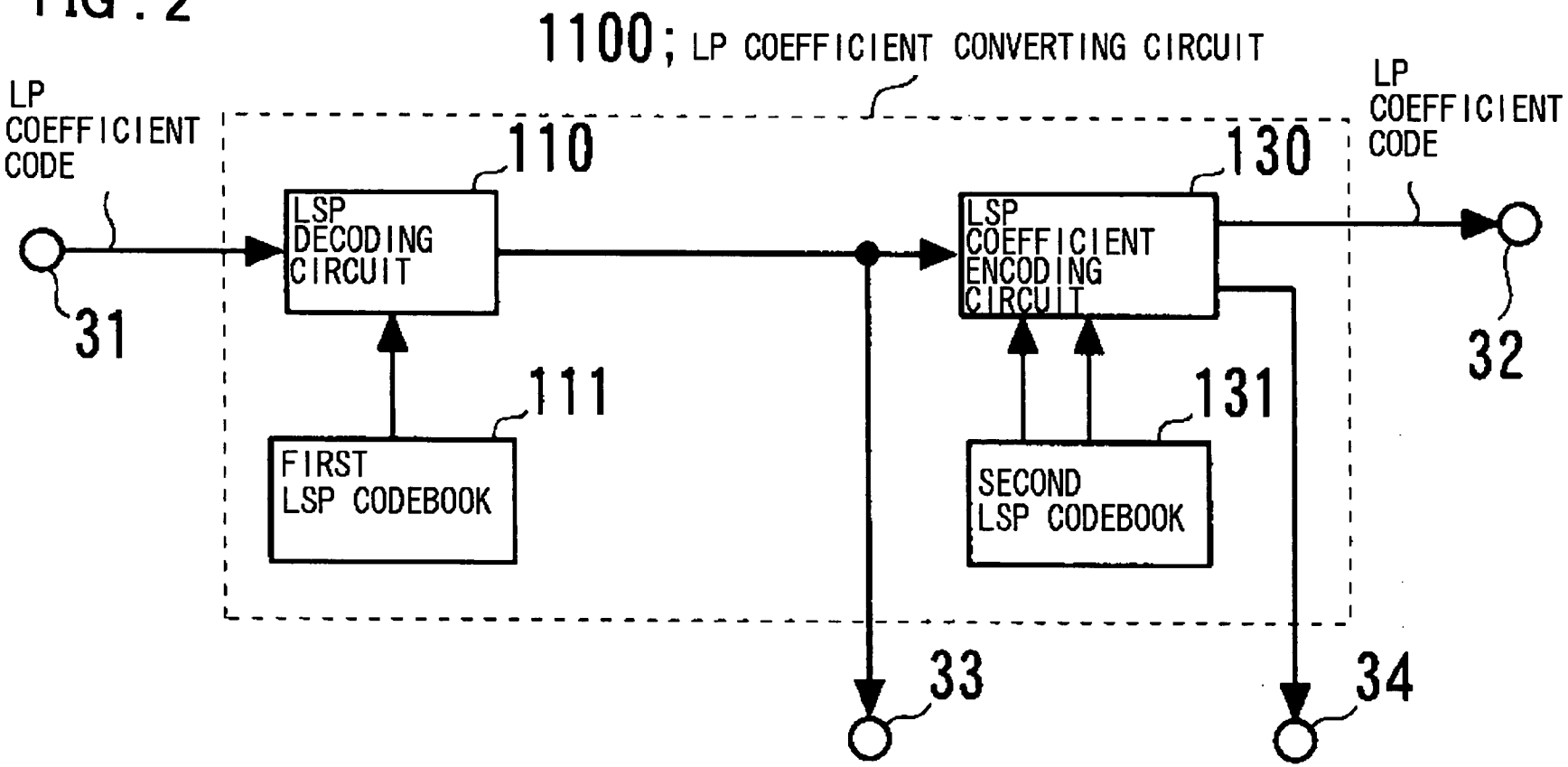
FIG. 2 is a diagram showing the configuration of an LP coefficient code converting circuit in a transcoder according to the present invention.

FIG. 2 depicts the configuration of the LP coefficient code converting circuit 1100. Referring to FIG. 2, the LP coefficient code converting circuit 1100 includes an LSP decoding circuit 110, a first LSP codebook 111, an LSP coefficient encoding circuit 130 and a second LSP codebook 131. Referring to FIG. 2, the constituent elements of the LP coefficient code converting circuit 1100 are described.

The LSP decoding circuit 110 decodes the LP coefficient code into corresponding LSP. The LSP decoding circuit 110 includes the first LSP codebook 111, in which there are stored plural sets of LSPs. More specifically, the LSP decoding circuit is supplied via the input terminal 31 with first LP coefficient code, output from the code demultiplexing circuit 1010, and reads out LSP corresponding to the first LSP coefficient code from the first LSP codebook 111 to output the so read out LSP as the first LSP to the LSP coefficient encoding circuit 130, as well as to output the read out LSP via an output terminal 33 to the LSP-LPC converting circuit 1110. For decoding the LSP from the LP coefficient codes, the LSP codebook of the system A is used, in accordance with the LSP decoding method of the system A.

The LSP coefficient encoding circuit 130 is supplied with the first LSP, output from the LSP decoding circuit 110, to read in the second LSP and the corresponding LP coefficient codes sequentially from the second LSP codebook 131 in which there are stored the LSPs of the plural sets. The LSP coefficient encoding circuit then selects the second LSP, having the smallest error from the first LSP, and outputs an LP coefficient code, corresponding thereto, as a second LP coefficient code, via an output terminal 32 as the second LP coefficient code, to the code multiplexing circuit 1020, while outputting the second LSP via an output terminal 34 to the LSP-LPC converting circuit 1110. In the method for selecting the second LSP, that is, in the method for quantizing and encoding the LSPs, an LSP codebook of the system B is used, in accordance with the method for quantizing and encoding the LSPs for the system B. As regards the quantization and encoding for the LSPs, reference may be had to the description of the paragraph 5.2.5 of the 'Publication 3'.

The above is the explanation for the LP coefficient code converting circuit 1100, and reversion is now made to the explanation with reference to FIG. 1.

The LSP-LPC converting circuit 1110 is supplied with the first LSP and the second LSP, output from the LP coefficient code converting circuit 1100, and converts the first LSP and the second LSP into a first LP coefficient $a_{1,j}$ and into a second LP coefficient $a_{2,j}$ to output the first LP coefficient $a_{1,j}$ to the target signal calculating circuit 1700, speech decoding circuit 1500 and to the impulse response calculating circuit 1120, as well as to output the second LP coefficient $a_{2,j}$ to the target signal calculating circuit 1700 and to the impulse response calculating circuit 1120. As for conversion from the LP to the LP coefficient, reference may be made to the description of the paragraph 5.2.4 of the 'Publication 3'.

The ACB code converting circuit 1200 re-reads the first ACB code, entered from the code demultiplexing circuit 1010, using the relationship of correspondence between the code of the system A and that of the system B, to obtain the second ACB code. The ACB code converting circuit 1200 outputs the second ACB code to the code multiplexing circuit 1020 as a code decodable by the ACB decoding method in the system B. The ACB code converting circuit 1200 also outputs the ACB delay, corresponding to the second ACB code, as the second ACB delay to the target signal calculating circuit 1700.

Figure 3:
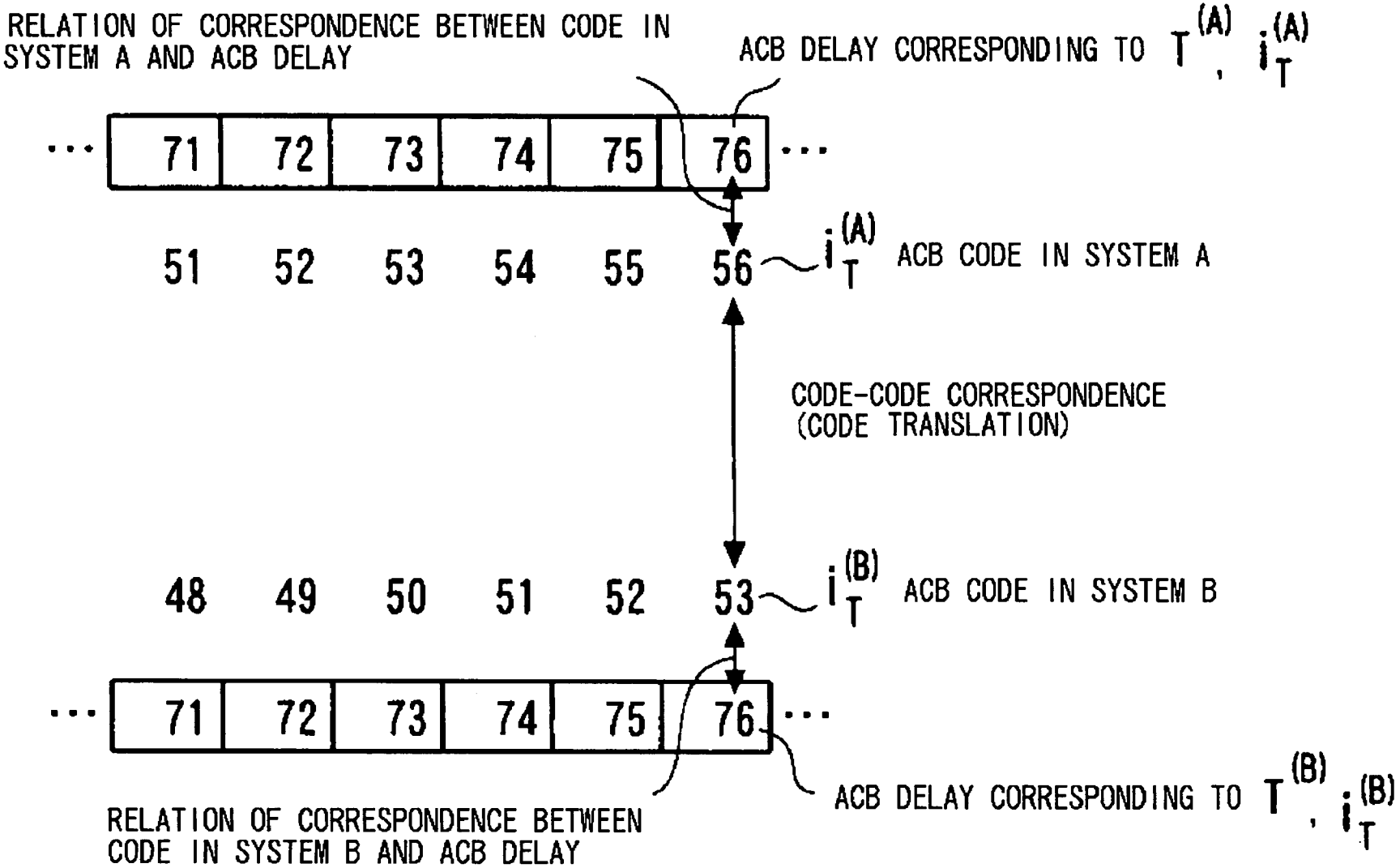
FIG. 3 illustrates a method for reading an ACB code for the relationship of correspondence between the ACB code and the ACB delay.

Referring to FIG. 3, code translation is described. It is assumed that, in case the ACB code of the system A $i_T^{(A)}$ is 56, the corresponding ACB delay $i_T^{(B)}$ is 76, for example. It is also assumed that, in case the ACB code of the system B $i_T^{(B)}$ is 53, the corresponding ACB delay $T^{(B)}$ is 76. Then, for converting the ACB code from the system A to the system B so that the value of the ACB delay is equal (in this case, 76), it is sufficient if the ACB code 56 of the system A, is correlated with the ACB code 53 of the system B. The above is the explanation for the code re-reading, and reversion is now made to the explanation with reference to FIG. 1.

The speech decoding circuit 1500 is supplied with the first ACB code, first FCB code and the first gain code, output from the code demultiplexing circuit 1010, while being supplied with the first LP coefficient from the LSP-LPC converting circuit 1110. The speech decoding circuit 1500 decodes the ACB delay, FCB signal and the gain from the first ACB signal, first FCB signal and the first gain code, respectively, using the ACB decoding method, FCB signal decoding method and the gain decoding method for the system A, respectively, with the so decoded ACB delay, FCB signal and gain being the first ACB delay, first FCB delay and the first gain, respectively. The speech deco ding circuit 1500 generates the ACB signal, using the first ACB delay, with the so generated ACB signal being then the first ACB signal. The speech decoding circuit 1500 generates a speech signal from the first ACB signal, first FCB signal, first gain and from the first LP coefficient to output the speech to the target signal calculating circuit 1700.

Figure 4:
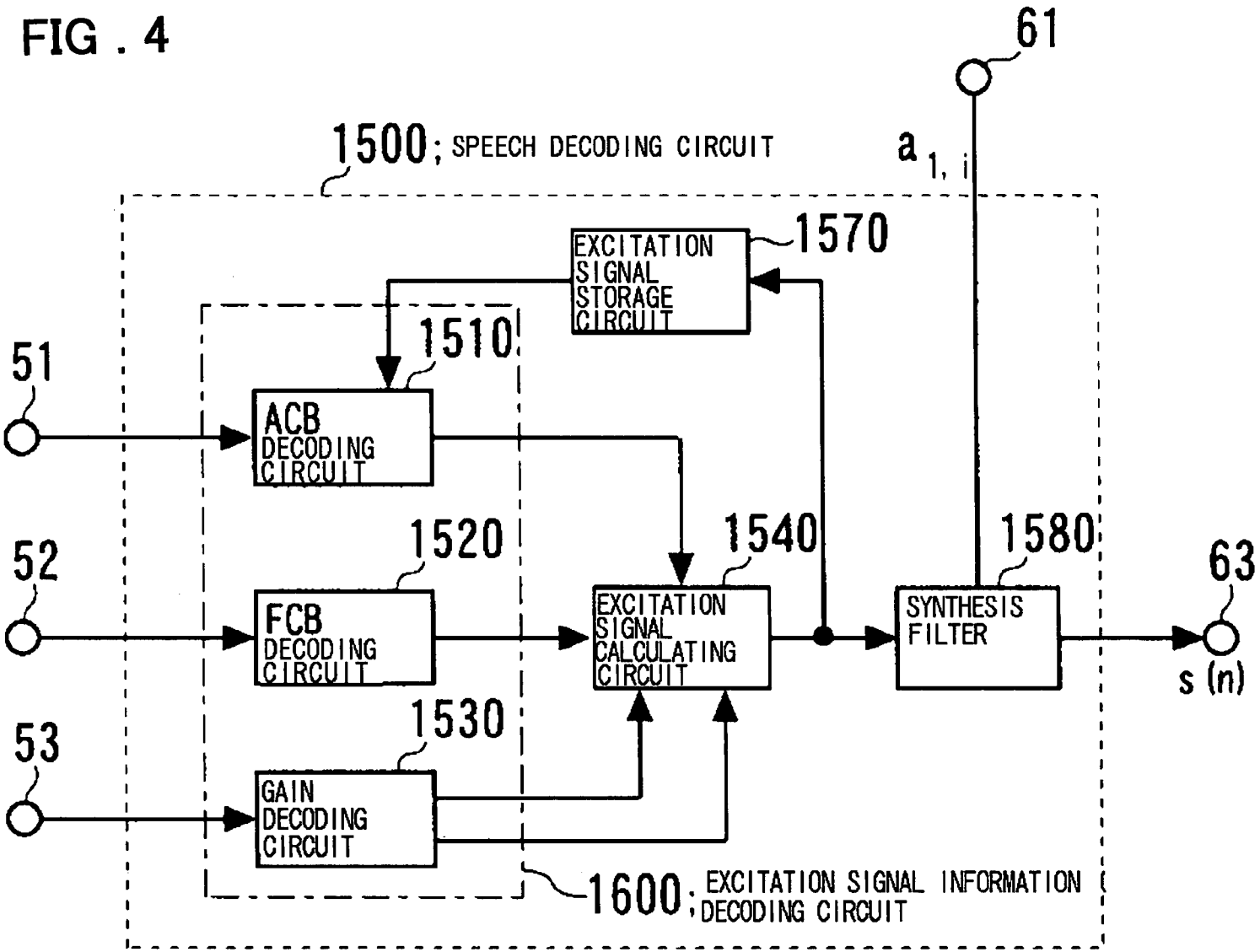
FIG. 4 is a diagram showing the configuration of a speech decoding circuit of the transcoder according to the present invention.

FIG. 4 shows the configuration of the speech decoding circuit 1500. Referring to FIG. 4, the speech decoding circuit 1500 includes an excitation signal information decoding circuit 1600, made up by an ACB decoding circuit 1510, an FCB decoding circuit 1520 and a gain decoding circuit 1530, an excitation signal calculating circuit 1540, an excitation signal storage circuit 1570 and a synthesis filter 1580. Referring to FIG. 4, component elements of the speech decoding circuit 1500 are described.

The excitation signal information decoding circuit 1600 decodes the information of excitation signal from the codes corresponding to the information of the excitation signal. Thus, the excitation signal information decoding circuit is supplied via an input terminals 51 to 53 with the first ACB signal, first FCD signal and with the first gain signal to decode the ACB delay, FCB signal and the gain, respectively, with the so decoded the ACB delay, FCB signal and the gain being the first ACB delay, first FCB signal and the first gain, respectively. It is noted that the first gain is made up by the ACB delay and the FCB delay, which are the first ACB delay and the first FCB delay, respectively. The excitation signal information decoding circuit 1600 generates the ACB signal, using past excitation signals and the first ACB delay, with the so generated ACB signal being the first ACB signal. The excitation signal information decoding circuit 1600 output the first ACB signal, first FCB signal, first ACB gain and the first FCB gain to the excitation signal calculating circuit 1540.

The ACB decoding circuit 1510, FCB decoding circuit-1520 gain decoding circuit 1530, making up the excitation signal information decoding circuit 1600, are now described in detail.

The ACB decoding circuit 1510 is supplied via an input terminal 51 with the first ACB code, output from the code demultiplexing circuit 1010, while being supplied with a past excitation signal output from the excitation signal storage circuit 1570. The ACB decoding circuit 1510 acquires the first ACB delay $T^{(A)}$, corresponding to the first ACB code, using the relationship of correspondence between the ACB code and the ACB delay for the system A, shown in FIG. 3, as described for the ACB code converting circuit 1200. In the excitation signal, a signal of $L_{sfy}^{(A)}$ samples, corresponding to the sub-frame length, is extracted from a point of past $T^{(A)}$ samples, as from the beginning point of the current sub-frame, to generate the first ACB signal. If $T^{(A)}$ is smaller than $L_{sfy}^{(A)}$, a vector of $T^{(A)}$ samples is extracted out, and a plural number of these vectors are repeatedly concatenated to yield a signal of a length of $L^{sfy(A)}$ samples, which are output to the excitation signal calculating circuit 1540. As to details of the method for generating the first ACB signals, reference may be had to the description of paragraphs 6.1 and 5.6 of the 'Publication 3'.

The FCB decoding circuit 1520 is supplied via an input terminal 52 with the first FCB signal, output from the code demultiplexing circuit 1010, to output a first FCB signal, corresponding to the first FCB signal, to the excitation signal calculating circuit 1540. The FCB signal is represented by a multi-path signal, as determined by the pulse position and by the pulse polarity, and the first FCB code is made up by a code corresponding to the pulse position (pulse position code) and the code corresponding to the pulse polarity (pulse polarity code). As for details of the method for generating FCB signals, represented by the multipath signals, reference may be had to the description of the paragraphs 6.1 and 5.7 of the 'Publication 3'.

The gain decoding circuit 1530 is supplied with the first gain code, output from the code demultiplexing circuit 1010, via an input terminal 53. The gain decoding circuit 1530 has therein a table, in which a plural number of gains are stored, and reads out the gain, corresponding to the first gain code, from the table. The gain decoding circuit 1530 outputs the first ACB gain, corresponding to the ACB gain, while outputting the first FCB gain, corresponding to the FCB gain, out of the read-out gain, to the excitation signal calculating circuit 1540. In case the first ACB gain and the first FCB gain are encoded collectively, a plural number of two-dimensional vectors, made up by the first ACB gain and the first FCB delay, are stored in the table. In case the first ACB gain and the first FCB gain are encoded individually, there are provided two tables, one of which has stored therein a plural number of the first ACB gains and the other of which has stored therein a plural number of the first FCB gains.

The excitation signal calculating circuit 1540 is supplied with first ACB signals, output from the ACB decoding circuit 1510, while being supplied with the first FCB signal, output from the FCB decoding circuit 1520, and with the first ACB gain and the first FCB gain, output from the gain decoding circuit 1530. The excitation signal calculating circuit 1540 sums a signal, obtained on multiplying the first ACB signal with the first ACB gain, to a signal obtained on multiplying the first FCB signal with the first FCB gain, to generate a first excitation signal. The excitation signal calculating circuit 1540 output the first excitation signal to the synthesis filter 1580 and to the excitation signal storage circuit 1570.

The excitation signal storage circuit 1570 is supplied with a first excitation signal, output from the excitation signal calculating circuit 1540, to store and hold the signal. The excitation signal storage circuit 1570 outputs the past first excitation signal, input in the past and stored/held therein, to the ACB decoding circuit 1510.

The synthesis filter 1580 is supplied with the first excitation signal, output from the excitation signal calculating circuit 1540, while being supplied via an input terminal 61 with the first LP coefficient output from the LSP-LPC converting circuit 1110. The synthesis filter 1580 actuates a linear prediction filter, having the first LP coefficient, with the first excitation signal, to generate a speech signal. The speech signal, thus generated, is sent via an output terminal 63 to the target signal calculating circuit 1700.

The above is the explanation for the speech decoding circuit 1500, and reversion is now made to the explanation with reference to FIG. 1.

The target signal calculating circuit 1700 is supplied from the LSP-LPC converting circuit 1110 with the first LSP and with the second LSP, while being supplied from the ACB code converting circuit 1200 with the second ACB delay corresponding to the second ACB code. The target signal calculating circuit 1700 is also supplied with the decoded speech from the speech decoding circuit 1500, with an impulse response signal from the impulse response calculating circuit 1120 and with a past second excitation signal stored and held in the second excitation signal storage circuit 1620. The target signal calculating circuit 1700 calculates the first target signal from the decoded speech, the first LP coefficient and from the second LP coefficient. The target signal calculating circuit 1700 then finds the second ACB signal and the optimum ACB gain from the past second excitation signal, impulse response signal, first target signal and from the second ACB delay. The target signal calculating circuit 1700 outputs the first target signal and the optimum ACB gain to the gain code generating circuit 1400, while outputting the second ACB signal to the gain code generating circuit 1400 and to the second excitation signal calculating circuit 1610.

Figure 5:
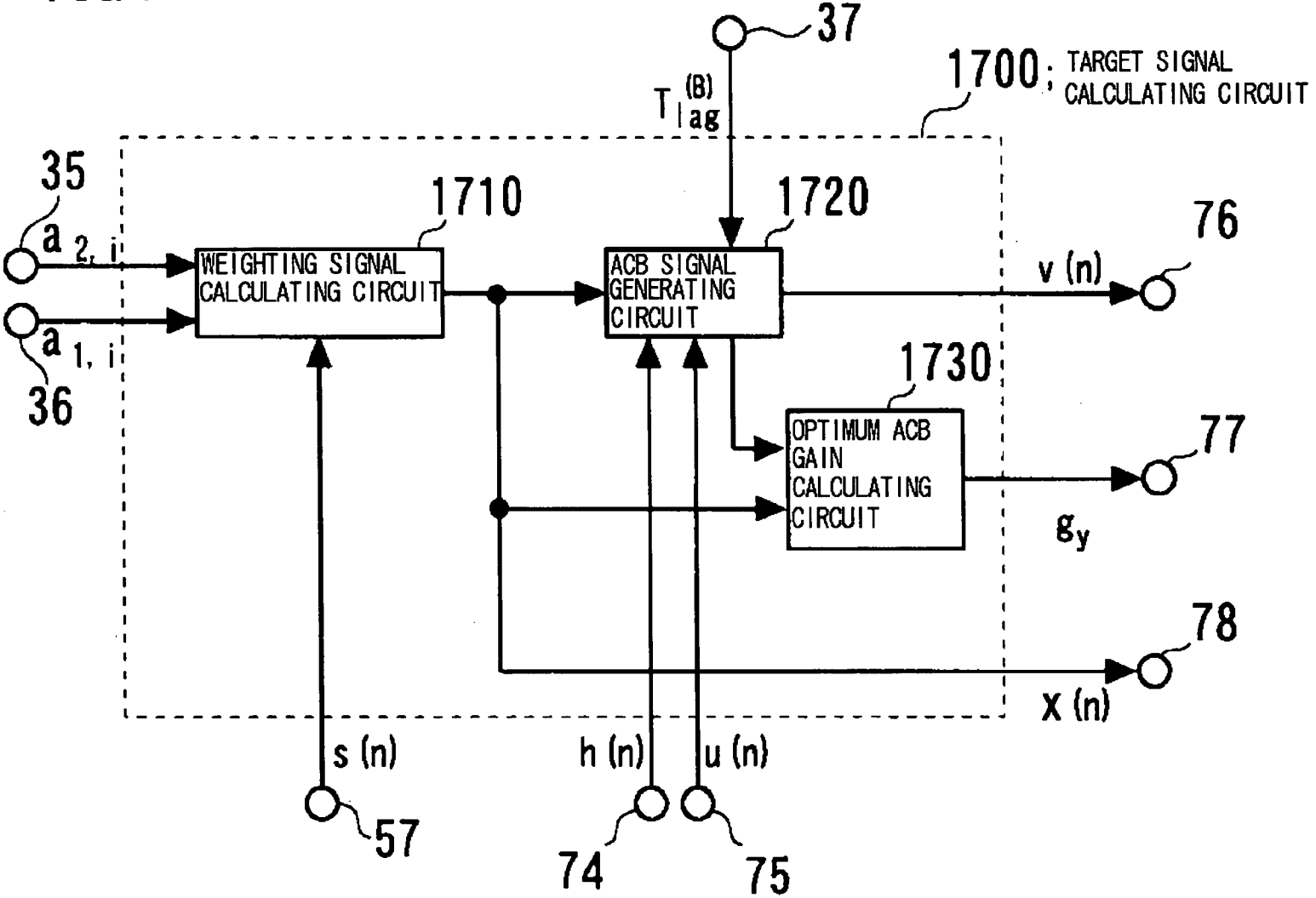
FIG. 5 is a diagram showing the configuration of a target signal calculating circuit in the transcoder according to the present invention.

FIG. 5 shows the configuration of the target signal calculating circuit 1700. Referring to FIG. 5, the target signal calculating circuit 1700 includes a weighting signal calculating circuit 1710, an ACB signal generating circuit 1720, and an optimum ACB gain calculating circuit 1730. Referring to FIG. 5, the component elements of the target signal calculating circuit 1700 are described.

The weighting signal calculating circuit 1710 is supplied with a decoded speech s(n), output from the synthesis filter 1580 of the speech dec ding circuit 1500, via an input terminal 57, while also being supplied with the first LP coefficient $a_{1,y}$ and with the second LP coefficient $a_{2,y}$, output from the LSP-LPC converting circuit 1110, via an input terminals 36 and 35, respectively. The weighting signal calculating circuit 1710 first forms an auditory perceptual weighting filter W(z), using first LP coefficients.

The weighting signal calculating circuit 1710 actuates the auditory perceptual weighting filter, by the decoded speech, to generate an auditory perceptually weighted speech signal. The weighting signal calculating circuit 1710 then forms an auditory perceptual weighting synthesis filter W(z)/A2(z), using the first LP coefficient and the second LP coefficient.

The weighting signal calculating circuit 1710 outputs a first target signal x(n), obtained on subtracting a zero-input response of the auditory perceptual weighting synthesis filter from the auditory perceptually weighted speech signal, to the ACB signal generating circuit 1720 and to the optimum ACB gain calculating circuit 1730, while outputting the same signal to a second target signal calculating circuit 1430 via an output terminal 78.

The ACB signal generating circuit 1720 is supplied with a first target signal, output from the weighting signal calculating circuit 1710, while being supplied via an input terminal 37 with a second ACB delay $T^{(B)}_{1ag}$, output from the ACB code converting circuit 1200. The ACB signal generating circuit 1720 is also supplied with an impulse response signal h(n), output from the impulse response calculating circuit 1120, while being supplied via an input terminal 75 with a past second excitation signal u(n), output from the second excitation signal storage circuit 1620.

The ACB signal generating circuit 1720 calculates the filter-processed past excitation signal with a delay k:

$$y_k(n), n=0, \ldots, L_{sfr}^{(B)}-1$$

by convolution of the signal which is extracted from the past second excitation signal with a delay k, with the impulse response signal.

Meanwhile, the delay k is the second ACB delay and the signal extracted with the delay k from the past second excitation signal is the second ACB signal v(n).

The ACB signal generating circuit 1720 outputs the second ACB signal to the second target signal calculating circuit 1430 and to the second excitation signal calculating circuit 1610, via an output terminal 76, while outputting the filter-processed past excitation signal yk(n), with the delay k, to the optimum ACB gain calculating circuit 1730.

The optimum ACB gain calculating circuit 1730 is supplied with the first target signal x(n), output from the weighting, signal calculating circuit 1710, and with the filter-processed past excitation signal yk(n), with the delay k, output from the ACB signal generating circuit 1720.

The optimum ACB gain calculating circuit 1730 then calculates, from the first target signal x(n) and the filter-processed past excitation signal yk(n), with the delay k, an optimum ACB gain gp, in accordance with the following equation:

$$g_P = \frac{\sum_{k=0}^{L_{sfr}^{(g)}} x(n) y_k(n)}{\sum_{k=0}^{L_{sfr}^{(g)}} y_k(n) y_k(n)}$$

where the optimum ACB gain gp is a gain which minimizes the distance between the first target signal x(n) and the filter-processed past excitation signal yk(n), with the delay k.

The optimum ACB gain calculating circuit 1730 outputs the optimum ACB gain gp to an ACB gain encoding circuit 1410 via an output terminal 77.

As regards the method for calculating the second ACB signal and the method for calculating the optimum ACB gain, reference may be made to paragraphs 6.1 and 5.6 of the 'Publication 3'. The above is the explanation for the target signal calculating circuit 1500, and reversion is now made to the explanation with reference to FIG. 1.

The impulse response calculating circuit 1120, supplied with the first LP coefficient and the second LP coefficient, output from the LSP-LPC converting circuit 1110, constitutes an auditory perceptual weighting synthesis filter, using the first and second LP coefficients.

The impulse response calculating circuit 1120 outputs an impulse response signal of the auditory perceptual weighting synthesis filter to the target signal calculating circuit 1700 and to the gain code generating circuit 1400. The transfer function of the auditory perceptual weighting synthesis filter is represented by the following equation:

$$\frac{W(z)}{A_2(z)} = \frac{A_1(z/\gamma_1)}{A_2(z)A_1(z/\gamma_2)}$$

where $$\frac{1}{A_2(z)} = \frac{1}{1+\sum_{i=1}^{P} \alpha_{2,i} z^{-i}}$$

is a transfer function of a linear predictive filter having second LP coefficients a2,i i=1, . . . , P, and $$W(z) = \frac{A_1(z/\gamma_1)}{A_1(z/\gamma_2)} = \frac{1+\sum_{i=1}^{P} \gamma_1^i \alpha_{1i} z^{-i}}{1+\sum_{i=1}^{P} \gamma_2^i \alpha_{1i} z^{-i}}$$

is a transfer function of an auditory perceptually weighted filter having second LP coefficient $a_{1,i}$ i=1, . . . , P.

It is noted that P is the degree of linear prediction, such as 10, while γ1 and γ2 are weighting controlling coefficients, such as 0.94 and 0.6.

An FCB code generating circuit 1800 is supplied with the first FCB signal, output from the code demultiplexing circuit 1010, to convert the first FCB signal into a code decodable by the system B. The FCB code generating circuit 1800 outputs the converted FCB signal as a second FCB signal to the gain code generating circuit 1400 and to the second excitation signal calculating circuit 1610. The FCB signal is made up by plural pulses and is represented by a multipath signal prescribed by the pulse position and the polarity (pulse polarity). The FCB signal is composed of a code corresponding to the pulse position (pulse position code) and a code corresponding to the pulse polarity (pulse polarity code). As for the method for expressing the FCB signal by the multi-path signal, reference may be made to the description of paragraph 5.7 of the 'Publication 3'.

Figure 6:
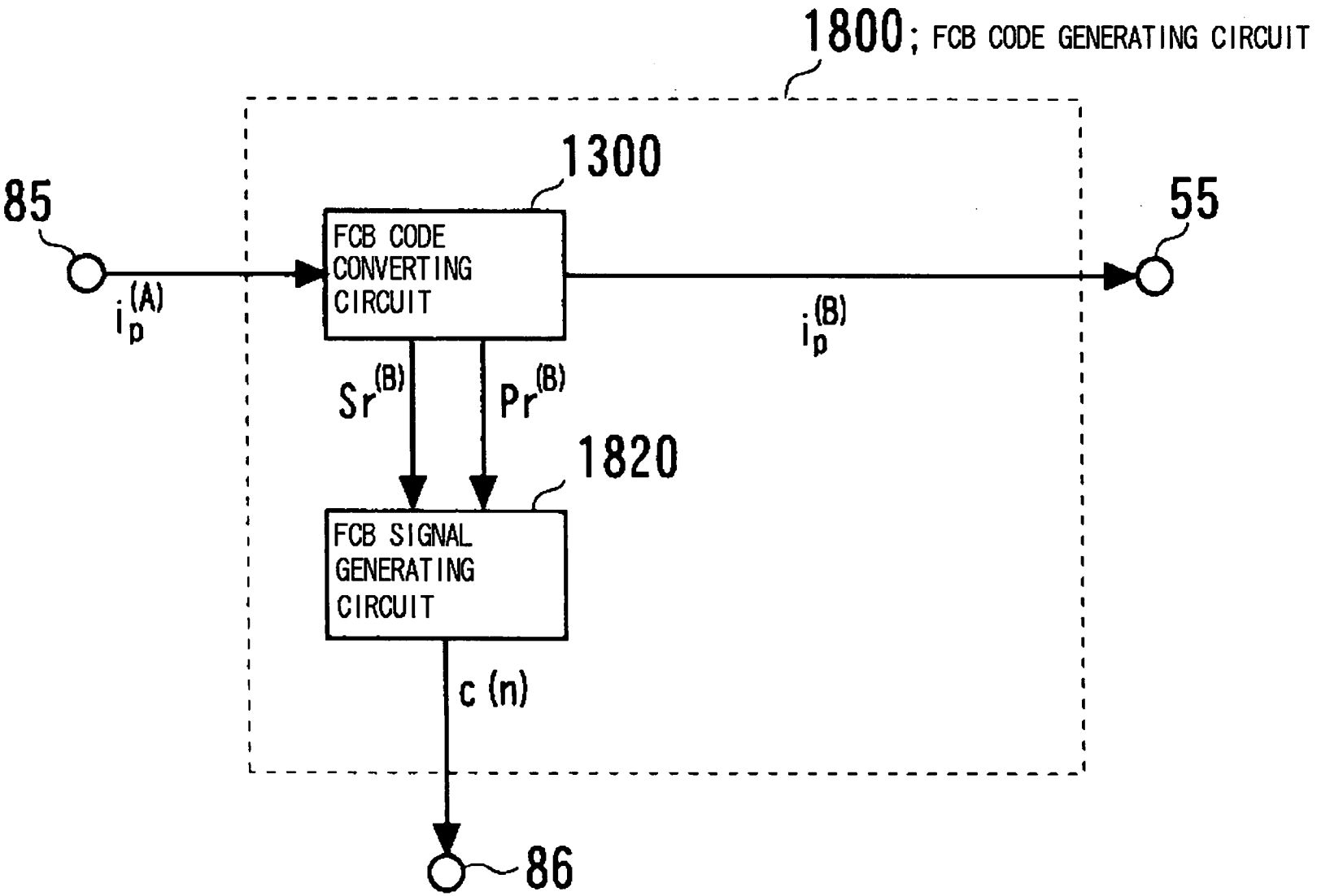
FIG. 6 is a diagram showing the configuration of an FCB code generating circuit in the transcoder according to the present invention.

FIG. 6 shows the configuration of the FCB code generating circuit 1800. Referring to FIG. 6, the FCB code generating circuit 1800 includes an FCB code converting circuit 1300 and an FCB signal generating circuit 1820. Referring to FIG. 6, component elements of the FCB code generating circuit 1800 are described.

The FCB code converting circuit 1300 translates a first FCB code $i^{(A)}_P$, entered via an input terminal 85 from the code demultiplexing circuit 1010, using the relationship of correspondence between the codes of the system A and those of the system B, to obtain a second FCB code $i^{(B)}_P$. The FCB code converting circuit 1300 outputs this second FCB code $i^{(B)}{}_P$ as a code decodable by the FCB decoding method of the system B to the code multiplexing circuit 1020 via an output terminal 55, while outputting the pulse position $P_i^{(A)}$ and the pulse polarity $S_i^{(A)}$, corresponding to the second FCB signal, to the FCB signal generating circuit 1820.

Figure 7:
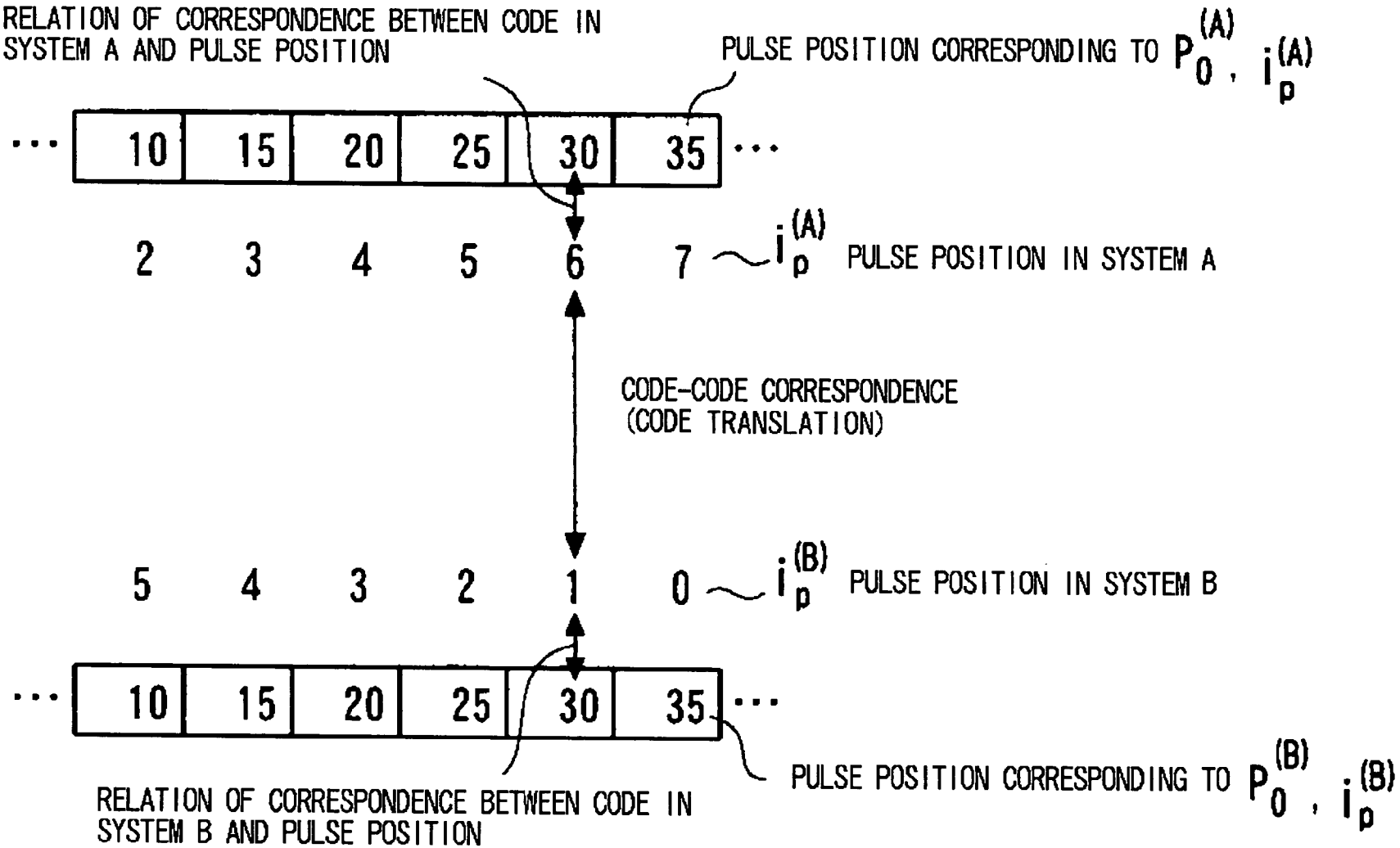
FIG. 7 illustrates a method for reading an ACB code for the relationship of correspondence between the pulse position code and the pulse position.

Referring to FIG. 7, replacement of the pulse position codes is described. It is assumed that, in case the pulse position code of the system A $i_P^{(A)}$ is 6, the corresponding pulse position $P_0^{(A)}$ is 30, for example. It is also assumed that, in case the pulse position code of the system B $i_P^{(B)}$ s 1, the corresponding pulse position $P_0^{(B)}$ is 30. Then, for converting the pulse position code from the system A to the system B so that the value of the pulse position is equal (in this case, 30), it is sufficient if the pulse position code 6 of the system A is correlated with the pulse position code 1 of the system B.

The above is the explanation for the replacement of the pulse position code and the pulse polarity code, and reversion is now made to the explanation with reference to FIG. 1.

The FCB signal generating circuit 1820 is supplied with the pulse position and with the pulse polarity, output from the FCB code converting circuit 1300. The FCB signal generating circuit 1820 outputs the FCB signal, determined by the pulse position and the pulse polarity, as the second FCB signal c(n), to an optimum FCB gain calculating circuit 1440 and to the second excitation signal calculating circuit 1610 via an output terminal 86.

The above is the explanation for the FCB code generating circuit 1800, and the pulse polarity code, and reversion is now made to the explanation with reference to FIG. 1.

The gain code generating circuit 1400 is supplied with the first target signal and output from the target signal calculating circuit 1700, with the second ACB signal, and with the optimum ACB gain, while being supplied with the second FCB signal output from the FCB code generating circuit 1800. The gain code generating circuit is also supplied with the impulse response signal, output from the impulse response calculating circuit 1120, and with the first LSP output from the LP coefficient code converting circuit 1100.

The gain code generating circuit 1400 first calculates the second target signal from the first target signal, second ACB signal, optimum ACB gain and from the impulse response signal, to calculate the optimum FCB gain from the second target signal, second FCB signal and the impulse response signal, while calculating the corrected FCB gain from the optimum FCB gain, to determine the speech decision value from the first LSP.

The gain code generating circuit 1400 calculates a first square error from the ACB gain and the optimum ACB gain, sequentially read from the ACB gain codebook, and from the optimum ACB gain, to calculate the second square error from the ACB gain and a corrected ACB gain.

The gain code generating circuit 1400 selects an ACB gain which will minimize the evaluation function, calculated from the weighting coefficient, calculated in turn from the speech decision value, the first square error, and from the second square error, and a corresponding ACB gain code.

The gain code generating circuit 1400 also calculates a third square error from the FCB gain, sequentially read from the FCB codebook, and the optimum FCB gain, while calculating the fourth square error from the FCB gain and the corrected FCB gain.

The gain code generating circuit 1400 selects the FCB gain, which will minimize the evaluation function, calculated from the weighting coefficient, calculated in turn from the speech decision value, third square error and the fourth square error, and the corresponding FCB gain code.

Finally, the gain code generating circuit 1400 outputs the second gain code, composed of the selected ACB gain code and the FCB gain code, as the code decodable by the gain decoding method of the system B, to the code multiplexing circuit 1020 via an output terminal 56.

Figure 8:
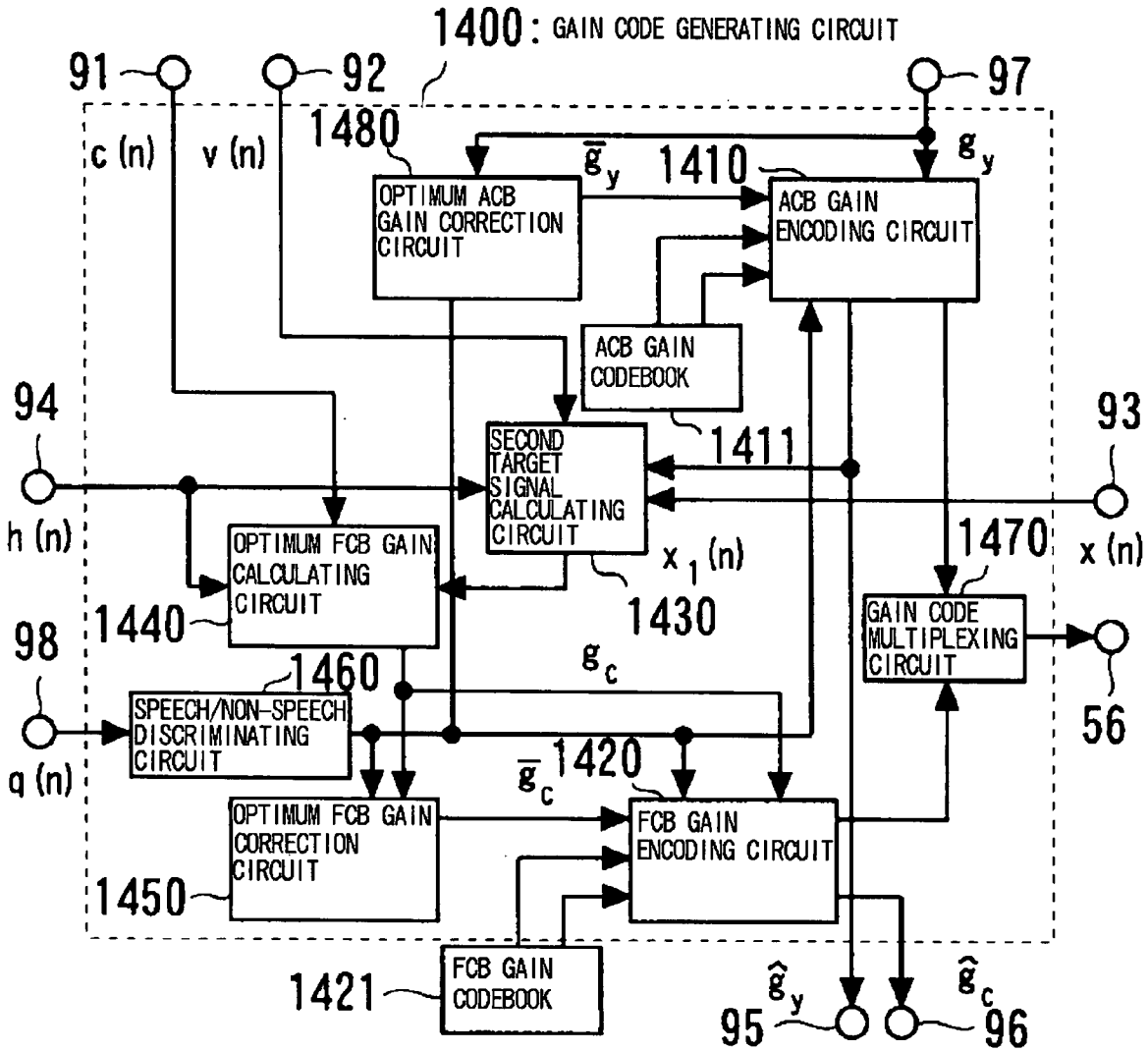
FIG. 8 is a diagram showing the configuration of a gain code generating circuit in the transcoder according to the present invention.

FIG. 8 shows the configuration of the gain code generating circuit 1400. Referring to FIG. 8, the gain code generating circuit includes an ACB gain encoding circuit 1410, an ACB gain codebook 1411, an FCB gain encoding circuit 1420, an FCB gain codebook 1421, a second target signal calculating circuit 1430, an optimum FCB gain calculating circuit 1440, an optimum FCB gain correction circuit 1450, and a speech/non-speech discriminating circuit 1460. Referring to FIG. 8, the constituent elements of the gain code generating circuit 1400 are described in detail.

The second target signal calculating circuit 1430 is supplied via an input terminal 92 with the second ACB signal v(n), output from the ACB signal generating circuit 1720, while being supplied via an input terminal 93 with the first target signal x(n), output from the weighting signal calculating circuit 1710. The second target signal calculating circuit is also supplied, via an input terminal 94, with an impulse response signal h(n), output from the impulse response calculating circuit 1120, while being supplied with the second ACB gain, output from the ACB gain encoding circuit 1410.

The second target signal calculating circuit 1430 calculates a filter-processed second ACB signal $$y(n), n=0, \ldots, L_{sfy}^{(B)}-1$$

by convolution of the second ACB signal with the impulse response signal, and subtracts a signal corresponding to y(n) multiplied with the second ACB gain $\hat{g}_y$ from the first target signal x(n) to yield second target signal $x_2(n)$, in accordance with the following equations:

$$x_2(n)=x(n)-\hat{g}_y y(n),$$

$$y(n)=v(n)*h(n).$$

The second target signal calculating circuit 1430 outputs the second target signal $x_2(n)$ to the optimum FCB gain calculating circuit 1440.

The optimum FCB gain calculating circuit 1440 is supplied via an input terminal 91 with the second FCB signal c(n), output from the FCB signal generating circuit 1820, while being supplied via an input terminal 94 with the impulse response signal h(n), output from the impulse response calculating circuit 1120. The optimum FCB gain calculating circuit 1440 is also supplied with the second target signal x2(*n*), output from the second target signal calculating circuit 1430, and calculates the filter-processed second FCB signal z(n)

$$z(n), n=0, \ldots, L_{sfy}^{(B)}-1$$

by convolution of the second FCB signal with the impulse response signal, to calculate an optimum FCB gain gc, from the second target signal x2($n$) and the filter-processed second FCB signal z(n), in accordance with the following equation:

$$g_p = \frac{\sum_{k=0}^{L_{sfr}^{(g)}} x_2(n)z(n)}{\sum_{k=0}^{L_{sfr}^{(g)}} z(n)z(n)}$$

It is noted that the optimum FCB gain gc is a gain which will minimize the distance between the second target signal x2($n$) and the filter-processed second FCB signal z(n).

The optimum FCB gain calculating circuit 1440 outputs the optimum FCB gain to the optimum FCB gain correction circuit 1450 and to the FCB gain encoding circuit 1420.

The speech/non-speech discriminating circuit 1460 sends the first LSP, output from the LSP decoding circuit 110, via an input terminal 98, while calculating the LSP variation from the first LSP and its long-term average value to determine the speech decision value from the LS variation.

The sequence of operations for finding the LSP variation is now described. In an n'th frame, the long-term average value of the LSP $\bar{q}_j(n)$.

is calculated in accordance with the following equation:

$$\bar{q}_j(n)=\beta\cdot\bar{q}_j(n-1)+(1-\beta)\cdot\hat{q}_j^{(N_{sfr})}(n), j=1, \ldots, N_y$$

where Np is the degree of linear prediction and β is e.g. 0.9.

The variation dq(n) of the LSP in the n'th frame is defined by the following equation:

$$d_q(n) = \sum_{j=1}^{N_p} \sum_{m=1}^{N_{sfr}} \frac{D_{qj}^{(m)}(n)}{\bar{q}_j(n)}$$

where $D_{q,j}^{(m)}(n)$ may be defined e.g. by an error between $\bar{q}_j(n)$ and $\hat{q}_j^{(m)}(n)$ as $D_{q,j}^{(m)}(n)=(\bar{q}_j(n)-\hat{q}_j^{(m)}(n))^2$ or $$D_{q,j}^{(m)}(n)=|\bar{q}_j(n)-\hat{q}_j^{(m)}(n)|.$$

Here, the latter equation is used. The domain with large variation dq(n) and the domain with small variation may be associated with the speech segment and with the non-speech segment, respectively. The speech decision value Vs is determined by the threshold value processing for the variation dq(n), that is, if $(d_q(n) \geqq C_{vs})$ then $V_s=1$ else $V_s=0$ (Vs=1 if dq(n) is not less than Cvs Vs=0 if dq(n) is less than Cvs) where Cvs is a predetermined constant, such as, for example, 2.2, Vs=1 corresponds to the speech segment and Vs=0 corresponds to the non-speech segment. The speech decision value is output to the optimum ACB gain correction circuit 1480, ACB gain encoding circuit 1410, optimum FCB gain correction circuit 1450 and to the FCB gain encoding circuit 1420.

The optimum FCB gain correction circuit 1480 is supplied with an optimum ACB gain, output from the ACB signal generating circuit 1720, and with the speech decision value, output from the speech/non-speech discriminating circuit 1460. When the speech decision value Vs is 0 (non-speech segment or un-voiced segment), the optimum ACB gain correction circuit 1480 sets the long-term average value of the optimum ACB gain as a corrected ACB gain. The optimum FCB gain correction circuit calculates the long-term average value of the optimum ACB gain in accordance with the following equation:

$$\bar{g}_y(n)=\alpha\cdot\bar{g}_y(n-1)+(1-\alpha)\cdot g_y(n)$$

where $g_y(n)$ is an optimum gain for the n'th sub-frame, $\bar{g}_y(n)$ is the long-term average value of the optimum ACB gain, and α is e.g. 0.9. For the long-term average value, an average value, a median value or the mode may be used.

On the other hand, when the speech decision value Vs is 1 (speech segment, or voiced segment), the optimum ACB gain correction circuit 1480 sets the optimum ACB gain itself as the corrected ACB gain.

The optimum ACB gain correction circuit 1480 outputs the corrected ACB gain to the ACB gain encoding circuit 1410.

The ACB gain encoding circuit 1410 is supplied via an input terminal 97 with the optimum ACB gain gp, output from the ACB signal generating circuit 1720, while being also supplied with the corrected ACB gain output from the optimum ACB gain correction circuit 1480 and with the speech decision value output from the speech/non-speech discriminating circuit 1460.

The ACB gain encoding circuit 1410 calculates a first square error from the ACB gain, sequentially read from the ACB gain codebook 1411, and from the optimum ACB gain from the input terminal 97, and calculates a second square error from the ACB gain and the corrected ACB gain, while calculating, from a weighting coefficient, calculated from the speech decision value, first square error and from the second square error, an evaluation function defined by the following equation:

$$E_{gy}=\mu\cdot(g_y-\hat{g}_y)^2+(1-\mu)\cdot(\tilde{g}_y-\hat{g}_y)^2$$

where $g_y$ is an optimum ACB gain, $\tilde{g}_y$ is a corrected ACB gain, $\hat{g}_y$ is an ACB gain sequentially read from the ACB codebook and μ is a weighting coefficient. For example, with the speech decision value Vs is 1 (speech segment), the weighting coefficient μ is 1.0 and, if Vs is 0 (non-speech segment), μ is 0.2.

The ACB gain encoding circuit 1410 selects the ACB gain, which will minimize the evaluation function, and outputs the selected ACB gain as the second ACB gain to the second target signal calculating circuit 1430, while outputting the selected ACB gain via an output terminal to the second excitation signal calculating circuit 1610 via an output terminal 95, and outputting the code corresponding to the second ACB gain as the ACB gain to a gain code multiplexing circuit 1470.

The optimum FCB gain correction circuit 1450 is supplied with the optimum FCB gain, output from the optimum FCB gain calculating circuit 1440, and with the speech decision value Vs, output from the speech/non-speech discriminating circuit 1460.

When the speech decision value Vs is 0 (non-speech segment), the optimum FCB gain correction circuit 1450 sets the long-term average value of the optimum ACB gain a corrected ACB gain. The optimum FCB gain correction circuit calculates the long-term average value of the optimum ACB gain in accordance with the following equation:

$$\bar{g}_c(n)=\alpha\cdot\bar{g}_c(n-1)+(1-\alpha)\cdot g_c(n)$$

where $g_c(n)$ is an optimum gain for the n'th sub-frame, $\bar{g}_c(n)$ is the long-term average value of the optimum ACB gain for the n'th sub-frame, and $\alpha$ is e.g. 0.9. For the long-term average value, an average value, a median value or the mode may be used.

On the other hand, when the speech decision value Vs is 1 (speech segment), the optimum FCB gain correction circuit 1450 sets the optimum FCB gain itself as the corrected FCB gain.

The optimum FCB gain correction circuit 1450 outputs the corrected FCB gain to the FCB gain encoding circuit 1420.

The FCB gain encoding circuit 1420 is supplied with the optimum FCB gain, output from the optimum FCB gain calculating circuit 1440, while being also supplied with the corrected FCB value, output from the optimum FCB gain correcting circuit 1450, and with the speech decision value output from the speech/non-speech discriminating circuit 1460. The FCB gain encoding circuit 1420 calculates a first square error from the FCB gain, sequentially read from the FCB gain codebook 1421, and from the optimum FCB gain from the input terminal 97, and calculates a second square error from the FCB gain and the corrected FCB gain, while calculating, from the weighting coefficient, calculated from the speech decision value, first square error and from the second square error, an evaluation function defined by the following equation:

$$E_{gc}=\mu\cdot(g_c-\hat{g}_c)^2+(1-\mu)\cdot(\tilde{g}_c-\hat{g}_c)^2$$

where $g_c$ is an optimum FCB gain, $\tilde{g}_c$ is a corrected FCB gain, $\hat{g}_c$ is an FCB gain sequentially read from the FCB codebook and $\mu$ is a weighing coefficient. For example, when the speech decision value Vs is 1 (speech segment), the weighting coefficient $\mu$ is 1.0 and, if Vs is 0 (non-speech segment), $\mu$ is 0.2.

The FCB gain encoding circuit 1420 selects the FCB gain, which will minimize the evaluation function, and outputs the selected FCB gain as the second ACB gain to the second excitation signal calculating circuit 1610 via an output terminal 96, while outputting the code corresponding to the second FCB gain as the FCB gain code to the gain code multiplexing circuit 1470.

The gain code multiplexing circuit 1470 is supplied with the ACB gain code, output from the ACB gain encoding circuit 1410, and with the FCB gain code, output from the FCB gain encoding circuit 1420, and outputs a second gain code, obtained on multiplexing the ACB gain code and the FCB gain code, as a code decodable by the gain decoding method of the system B, to the code multiplexing circuit 1020 via an output terminal 56.

The above is the explanation for the gain code generating circuit 1400, and the pulse polarity code, and reversion is now made to the explanation with reference to FIG. 1.

The second excitation signal calculating circuit 1610 is supplied with the second ACB signal, output from the target signal calculating circuit 1700 and with the second FCB signal, output from the FCB code generating circuit 1800, while also being supplied with the second ACB gain and the second FCB gain output from the gain code generating circuit 1400. The second excitation signal calculating circuit 1610 sums a signal obtained on multiplying the second ACB signal with the second ACB gain to a signal obtained on multiplying the second FCB signal with the second FCB gain to generate the second excitation signal, which second excitation signal is output to the second excitation signal storage circuit 1620.

The second excitation signal storage circuit 1620 is supplied with the second excitation signal, output from the second excitation signal calculating circuit 1610, to store and hold the second excitation signal, while outputting the second excitation signal, input in the past and stored and held therein to the target signal calculating circuit 1700. The above is the explanation of the first embodiment of the present invention.

Second Embodiment

Figure 9:
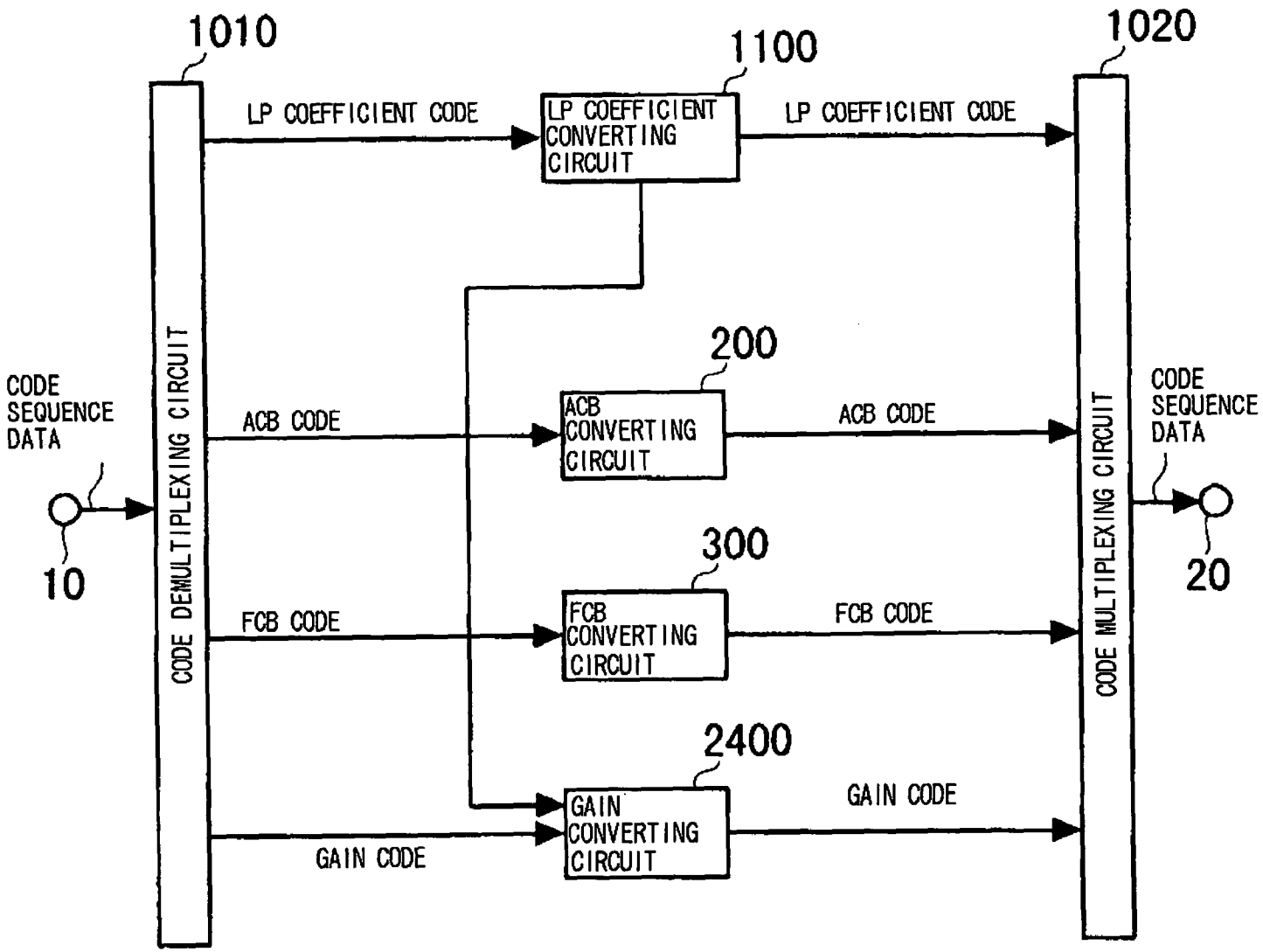
FIG. 9 is a diagram showing the configuration of a second embodiment of the transcoder according to the present invention.

The second embodiment of the present invention is hereinafter described. FIG. 9 shows the configuration of the second embodiment of the code conversion apparatus of the present invention. In FIG. 9, an LP coefficient code converting circuit 1100 and a gain code converting circuit 2400 are substituted for the coefficient converting circuit 100 and the gain code converting circuit 400 of FIG. 12, respectively, and an interconnecting line is drawn across the LP coefficient code converting circuit 1100 and the gain code converting circuit 2400. In the following, the elements which are the same as those show in FIG. 12 are not described, and only the points of difference are described.

The LP coefficient code converting circuit 1100 is similar to that of the first embodiment described with reference to FIG. 1. However, the manner of interconnection thereof to other circuits is different from that of the first embodiment. Specifically, the first LSP is output to the gain code converting circuit 400.

The gain code converting circuit 2400 is supplied with the first gain code, output from the code demultiplexing circuit 1010, and with the first LSP output from the LP coefficient code converting circuit 1100.

The gain code converting circuit 2400 computes the corrected ACB gain and the corrected FCB gain, from the first gain obtained on decoding the first gain code by the gain decoding method of the system A (first ACB gain and first FCB gain), to determine the speech decision value from the first LSP.

The gain code converting circuit 2400 computes the first square error from the first ACB gain and the first ACB gain, sequentially read from the ACB gain codebook, to compute the second square error from the ACB gain and the corrected ACB gain.

The gain code converting circuit 2400 also selects the ACB gain, which will minimize the evaluation function, calculated from the weighting function, in turn calculated from the speech decision value, the first square error and the second square error, and the corresponding ACB gain code.

The gain code converting circuit 2400 also calculates the third square error from the FCB gain, sequentially read from the FCB gain codebook, and the first FCB gain, while calculating the fourth square error from the FCB gain and the corrected FCB gain. The gain code converting circuit 2400 also selects the FCB gain, which will minimize the evaluation function, calculated from the weighting function, in turn calculated from the speech decision value, the third square error and the fourth square error, and the corresponding ACB gain code.

Finally, the gain code converting circuit 2400 outputs the second gain code, made up by the selected ACB gain code and the FCB gain code, to the code multiplexing circuit 1020, as a code decodable by the gain decoding method in the system B.

Figure 10:
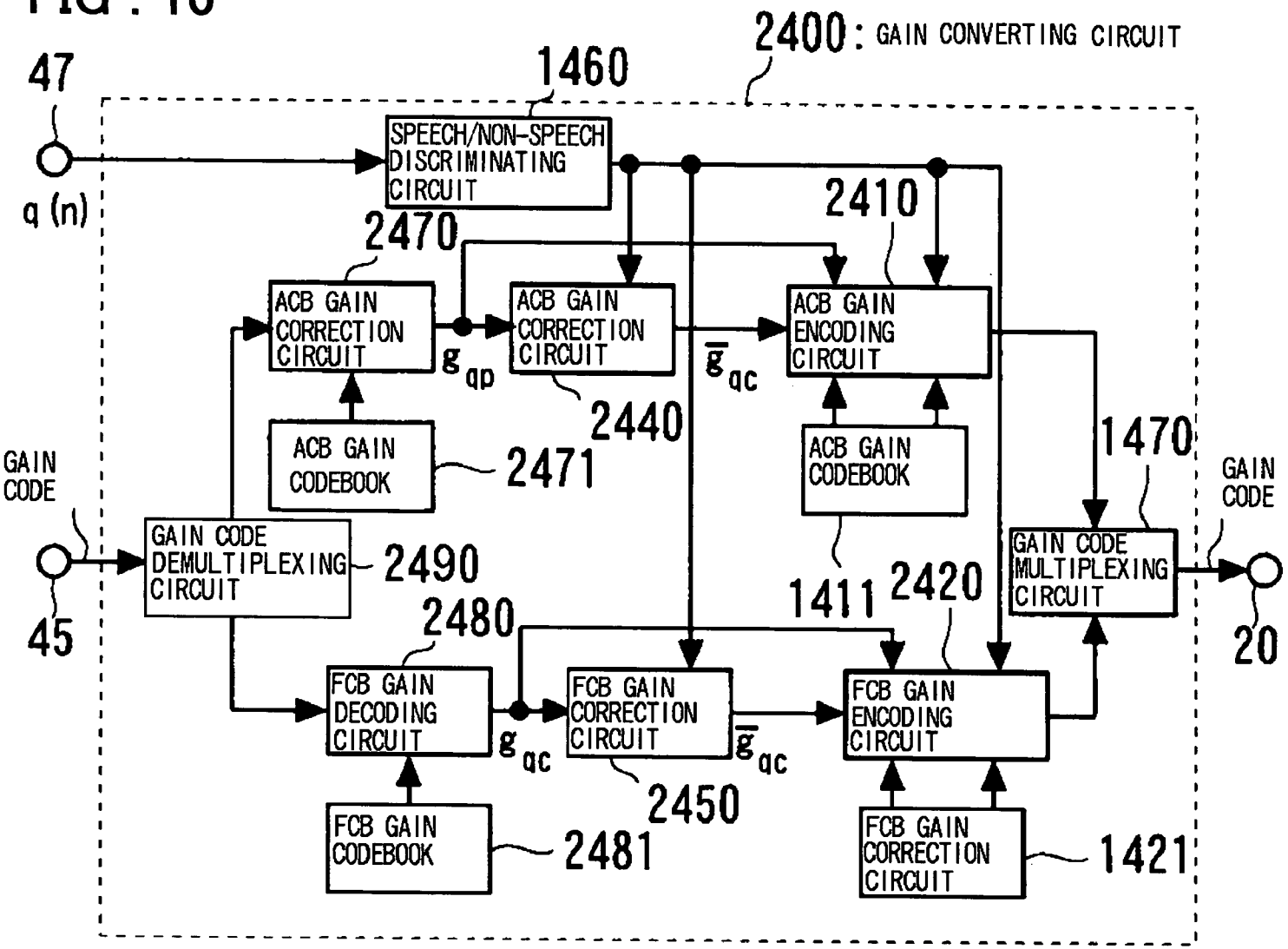
FIG. 10 is a diagram showing the configuration of a gain code generating circuit in the transcoder according to the present invention.
Figure 11:
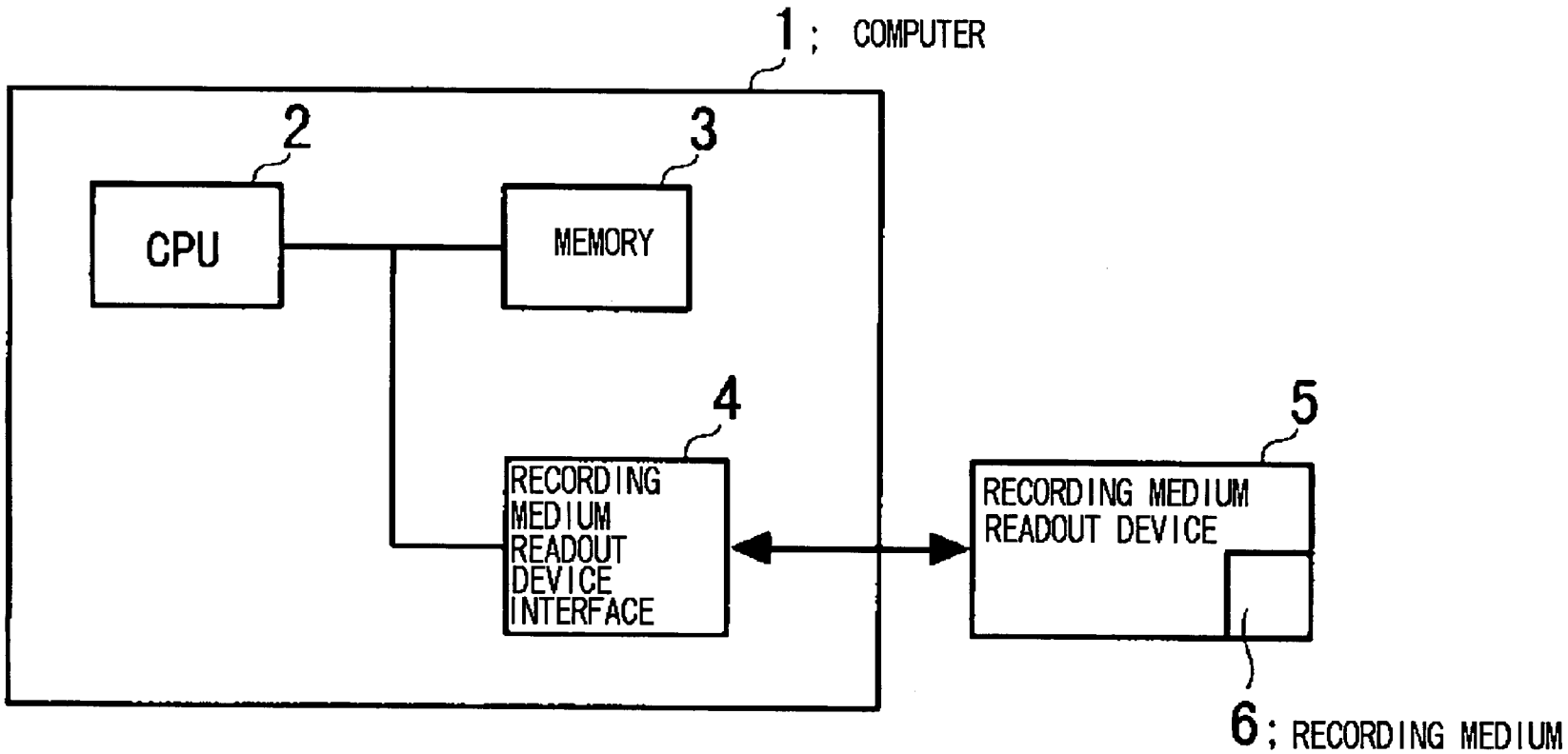
FIG. 11 is a diagram showing the configuration of third and fourth embodiments of the transcoder according to the present invention.

FIG. 10 shows the configuration of the gain code converting circuit 2400 of FIG. 9. Referring to FIG. 10, the gain code converting circuit 2400 includes a voiced/un-voiced discrimination circuit 1460, a gain code separation circuit 2490, an ACB gain correction circuit 2470, an ACB gain codebook 2471, an ACB gain correction circuit 2440, an ACB gain encoding circuit 2410, an ACB gain codebook 1411, an FCB gain decoding circuit 2480, an FCB gain codebook 2481, an FCB gain correction circuit 2450, an FCB gain encoding circuit 2420, an FCB gain codebook 1421, and a gain code multiplexing circuit 1470. Referring to FIG. 10, the component elements of the gain code converting circuit 2400 of the present embodiment are described. In FIG. 10, the non-speech discrimination circuit 1460 and the gain code multiplexin circuit 1470 are basically the same as the corresponding component elements, shown in FIG. 8, and hence the explanation thereof are omitted in the ensuing description.

The gain code demultiplexing circuit 2490 is supplied via an input terminal 45 with the first gain code, output from the code demultiplexing circuit 1010, and separates the codes corresponding to the ACB gain and the FCB gain, that is, the first ACB gain code and the first FCB gain code, from the first gain code, to output the first ACB gain code and the first FCB gain code to the gain correction circuit 2470 and to the FCB gain decoding circuit 2480, respectively.

The ACB gain correction circuit 2470 includes an ACB gain codebook 2471, having stored therein plural sets of the ACB gain, and is supplied with the first ACB gain code, output from the gain code demultiplexing circuit 2490. The ACB gain correction circuit reads out the ACB gain corresponding to the first ACB code from the first ACB gain codebook 2471 to output the so read out ACB gain as the first ACB gain to the ACB gain correction circuit 2440 and to the ACB gain encoding circuit 2410. The decoding of the ACB gain from the ACB gain ode is carried out in accordance with the ACB gain decoding method for the system A and uses the ACB gain codebook of the system A.

The FCB gain decoding circuit 2480 includes an FCB gain codebook 2481, having plural sets of the FCB gain stored therein, and is supplied with the first FCB gain code, output from the gain code demultiplexing circuit 2490. The FCB gain correction circuit reads out the FCB gain corresponding to the first FCB code from the first FCB gain codebook 2481 to output the so read out FCB gain as the first FCB gain to the FCB gain correction circuit 2450 and to the FCB gain encoding circuit 2420. The decoding of the FCB gain from the FCB gain code is carried out in accordance with the FCB gain decoding method for the system A and uses the FCB gain codebook of the system A.

The ACB gain correction circuit 2440 is supplied with the first ACB gain, output from the ACB gain correction circuit 2470, and with the speech decision value, output from the speech/non-speech discriminating circuit 1460. If the speech decision value Vs is 0 (non-speech segment), the ACB gain correction circuit sets the long-term average value of the first ACB gain as the corrected ACB gain.

In the non-speech segment, the ACB gain correction circuit 2440 calculates the long-term average value of the first ACB gain, in accordance with the following equation:

$$\bar{g}_{qc}(n)=\alpha\cdot\bar{g}_{qc}(n-1)+(1-\alpha)\cdot g_{qc}(n)$$

where $g_{qc}(n)$ is the first ACB gain in the n'th sub-frame and $\bar{g}_{qc}(n)$ is the long-term average value of the first ACB gain for the n'th sub-frame, and $\alpha$ is e.g. 0.9. For the long-term average value, an average value, a median value or the mode may be used.

On the other hand, when the speech decision value Vs is 1 (speech segment), the ACB gain correction circuit 2440 sets the optimum ACB gain itself as the corrected ACB gain.

The ACB gain correction circuit 2440 outputs the corrected ACB gain to the ACB gain encoding circuit 2410.

The FCB gain correction circuit 2450 is supplied with the first FCB gain, output from the FCB gain decoding circuit 2480, while being also supplied with the speech decision value output from the speech/non-speech discriminating circuit 1460. If the speech decision value Vs is 0 (non-speech segment), the FCB gain correction circuit 2450 sets the long-term average value of the first FCB gain as the corrected FCB gain. In the non-speech segment, the FCB gain correction circuit calculates the long-term average value of the first FCB gain, in accordance with the following equation:

$$\bar{g}_{gqp}(n)=\alpha\cdot\bar{g}_{qp}(n-1)+(1-\alpha)\cdot g_{qp}(n)$$

where $g_{qp}(n)$ is the first FCB gain in the n'th sub-frame and $\bar{g}_{qp}(n)$ is the long-term average value of the first FCB gain for the n'th sub-frame, and $\alpha$ is e.g. 0.9. For the long-term average value, an average value, a median value or the mode may be used.

On the other hand, when the speech decision value Vs is 1 (speech segment), the FCB gain correction circuit 2450 sets the first FCB gain itself as the corrected FCB gain.

The FCB gain correction circuit 2450 outputs the corrected FCB gain to the FCB gain encoding circuit 2420.

The ACB gain encoding circuit 2410 is supplied with the first ACB gain, output from the ACB gain decoding circuit 2470, and with the corrected ACB gain, output from the ACB gain correction circuit 2440, while being also supplied with the speech decision value output from the speech/non-speech discriminating circuit 1460.

The ACB gain encoding circuit 2410 calculates a first square error from the ACB gain, sequentially read in from the ACB gain codebook 1411, and from the first ACB gain, and calculates a second square error from the ACB gain and the corrected ACB gain, while calculating, from the weighting coefficient, calculated from the speech decision value, the first square error and the second square error, the valuation function defined by the following equation:

$$E_{gqp}=\mu\cdot(g_{qp}-\hat{g}_{qp})^2+(1-\mu)\cdot(\tilde{g}_{qp}-\hat{g}_{qp})^2$$

where $g_{qp}$ is the first ACB gain, $\tilde{g}_{qp}$ is the uncorrected ACB gain, $\hat{g}_{qp}$ is the ACB gain, sequentially read in from the ACB gain codebook 1411, and $\mu$ is the weighting coefficient. For example, if the speech decision value Vs is 1 (speech segment) or 0 (non-speech segment), the weighting coefficient $\mu$ is set to 1.0 or 0.2, respectively.

The ACB gain encoding circuit 2410 selects the ACB gain which minimizes the evaluation function and outputs the so selected ACB gain and the code corresponding to the second ACB gain to the gain code multiplexing circuit 1470, as the second ACB gain and as the second ACB gain code, respectively.

The FCB gain encoding circuit 2420 is supplied with the first FCB gain, output from the FCB gain decoding circuit 2480, with the corrected FCB gain, output from the FCB gain correction circuit 2450, and with the speech decision value, output from the speech/non-speech discriminating circuit 1460.

The FCB gain encoding circuit 2420 calculates a third square error from the FCB gain, sequentially read from the FCB gain codebook 1421, and from the first FCB gain, and calculates a second square error from the FCB gain and the corrected FCB gain, while calculating, from a weighting coefficient, calculated from the speech decision value, third square error and from the fourth square error, an evaluation function defined by the following equation:

$$E_{gqp}=\mu\cdot(g_{qp}-\hat{g}_{qp})^2+(1-\mu)\cdot(\tilde{g}_{qp}-\hat{g}_{qp})^2$$

where $g_{qp}$ is the first FCB gain, $\tilde{g}_{qp}$ is an uncorrected FCB gain, $\hat{g}_{qp}$ is an FCB gain sequentially read from the FCB gain codebook 1421 and $\mu$ is a weighting coefficient. For example, if the speech decision value Vs is 1 (speech segment), the weighting coefficient $\mu$ is 1.0 and, if the speech decision value Vs is 0 (non-speech segment), $\mu$ is 0.2.

The FCB gain encoding circuit 2420 selects the FCB gain, which will minimize the evaluation function, and outputs the selected FCB gain as the second FCB gain and the code corresponding to the second FCB gain as the second FCB gain code to the gain code multiplexing circuit 1470.

Third Embodiment

The code conversion apparatus of the above-described embodiments of the present invention may be implemented by computer control, such as digital signal processor. FIG. 1 schematically shows an apparatus configuration in case of implementing the code conversion processing of the above embodiments by a program executed by a computer (processor) as a third embodiment of the present invention. In order for a computer 1, executing the program read out from a recording medium 6, to execute the code conversion processing of converting the first code, obtained on encoding the speech by a first encoding/decoding device, into a second code decodable by the second encoding/decoding device, there is recorded, on a recording medium 6, a program to cause the computer to execute (a) the processing of obtaining first linear prediction coefficient from a first code sequence;

(b) the processing of obtaining the information on the excitation signal from the first code sequence;

(c) the processing of obtaining the excitation signals from the information on the excitation signals;

(d) the processing of generating speech signals by actuating a filter, having first linear prediction coefficient, by the excitation signal;

(e) the processing of calculating the gain (optimum gain) which will minimize the distance between the second speech signal generated by the information obtained from the second code sequence and the first speech signal;

(f) the processing of correcting the optimum gain; and (g) the processing of calculating a first square error from an optimum gain corrected (corrected optimum gain) and a gain read out from a gain codebook of the second system, calculating a second square error from the optimum gain and from the gain read out from the gain codebook, and selecting, from the gain codebook, a gain minimizing the evaluation function which is based on the first and second square errors, to find the gain information in the second code sequence. This program is read out from the recording medium 6 to the memory 3 via a recording medium readout device 5 and an interface 4 for execution. The program may be stored in a non-volatile memory, such as a mask ROM or a flash memory. The recording medium includes not only a non-volatile memory but also a wired or wireless communication medium, carrying the program, used for transmitting the program from a server device by a computer, in addition to a medium, exemplified by CD-ROM, FD, Digital Versatile Disc (DVD), magnetic tape (MT) or a mobile HDD.

In a fourth embodiment of the present invention, in order for the computer 1, executing the program read out from a recording medium 6, to execute the code conversion processing of converting the first code, obtained on encoding the speech by a first encoding/decoding device, into a second code decodable by the second encoding/decoding device, there is recorded, on a recording medium 6, a program to cause the computer to execute (a) the processing of decoding the gain information from a first code sequence;

(b) the processing of correcting the gain decoded (decoded gain); and (c) the processing of calculating a first square error from a decoding gain corrected (corrected decoding gain) and a gain read out from a gain codebook of the second system, calculating a second square error from the decoded gain and from the gain read out from the gain codebook, and selecting, from the gain codebook, a gain minimizing the evaluation function which is based on the first and second square errors, to find the gain information in the second code sequence.

Although the preferred embodiments of the present invention have been described in the above, it is to be noted that the present invention is not limited to the configuration of the above-described embodiments and may encompass various modifications and corrections which may be feasible by those skilled in the art within the scope of the claims.

INDUSTRIAL UTILIZABILITY

According to the present invention, described above, there may be obtained a meritorious effect that it is possible to prevent the sound quality from being deteriorated due to the background noise in a non-speech segment, by deriving an optimum gain from the first speech signal, obtained from the first code sequence on actuating a synthesis filter having a first linear prediction coefficient, and from the second speech signal, generated by the information obtained from the second code sequence, correcting the optimum gain, finding the gain information in a second code sequence based on the optimum gain corrected, the optimum gain and the gain read out from the gain codebook in the second system, and by finding the second gain using an evaluation function which will reduce temporal variations of the second gain in the non-speech segment. The above meritorious effect may be achieved, according to the present invention, by decoding the gain information from the first code sequence, correcting the decoded gain, finding the gain information in the second code sequence based on the decoded gain corrected, the decoded gain and on the gain read out from the gain codebook in the second system and by finding the second gain using an evaluation function which will reduce the temporal variation of the second gain in the non-speech segment.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A code converting method for converting a first code sequence conforming to a first system to a second code sequence conforming to a second system, comprising the steps of:

acquiring a first linear prediction coefficient and first information on an excitation signal from said first code sequence and actuating a filter having said first linear prediction coefficient with the excitation signal obtained from said first information to generate a first speech signal;

deriving an optimum gain based on a second speech signal generated by second information obtained from said second code sequence, and based on said first speech signal;

correcting said optimum gain to generate corrected optimum gain; and finding gain information in said second code sequence based on said corrected optimum gain, said optimum gain and on a gain read out from a gain codebook for said second system.

2. The code converting method according to claim 1, further comprising the steps of:

determining a speech decision value, discriminating a speech segment/non-speech segment, based on said first linear prediction coefficient; and finding the gain information in said second code sequence, using an evaluation function which will decrease a temporal variation of the gain in said second code sequence, when said speech decision value indicates the non-speech segment.

3. The code converting method according to claim 1, further comprising the steps of:

calculating a first square error from the corrected optimum gain and from the gain read out from said gain codebook;

calculating a second square error from said optimum gain and from the gain read out from said gain codebook; and selecting a gain minimizing an evaluation function which is based on said first square error and said second square error from said gain codebook to find the gain information in said second code sequence.

4. The code converting method according to claim 3, wherein said evaluation function is composed of said first square error, said second square error and weighting coefficients.

5. The code converting method according to claim 3, further comprising the steps of:

determining a speech decision value, discriminating a speech segment/non-speech segment, based on said first linear prediction coefficient;

said evaluation function being found by taking a weighted average value of said first and second square errors by weighting coefficients; and setting said weighting coefficients to respective preset values, based on said speech decision value, depending on the speech segment and the non-speech segment, to calculate said evaluation function.

6. The code converting method according to claim 1, wherein said corrected optimum gain is based on a long-term average value of said optimum gain.

7. The code converting method according to claim 1, wherein the gain minimizing the distance between the second speech signal generated by the information obtained from said second code sequence and said first speech signal is found as said optimum gain.

8. A code converting apparatus for converting a first code sequence conforming to a first system to a second code sequence conforming to a second system, said apparatus comprising:

a speech decoding circuit for acquiring a first linear prediction coefficient and first information on an excitation signal from said first code sequence and actuating a filter having said first linear prediction coefficient with the excitation signal obtained from said first information to generate a first speech signal;

an optimum gain calculating circuit for calculating an optimum gain based on a second speech signal generated by second information obtained from said second code sequence, and based on said first speech signal;

an optimum gain correcting circuit for correcting said optimum gain to generate corrected optimum gain; and a gain encoding circuit for finding the gain information in said second code sequence based on said corrected optimum gain, said optimum gain and on a gain read out from a gain codebook for said second system.

9. The code converting apparatus according to claim 8, wherein said gain encoding circuit includes a unit for finding the gain information in said second code sequence by calculating a first square error from the corrected optimum gain and from the gain read out from said gain codebook;

calculating a second square error from said optimum gain and from the gain read out from said gain codebook; and selecting a gain minimizing an evaluation function which is based on said first square error and said second square error from said gain codebook to find the gain information in said second code sequence.

10. The code converting apparatus according to claim 9, wherein said evaluation function is composed of said first square error, said second square error and weighting coefficients.

11. The code converting apparatus according to claim 9, further comprising;

a speech/non-speech discriminating circuit for outputting a speech decision value, discriminating a speech segment/non-speech segment, based on said first linear prediction coefficient;

said gain encoding circuit finding said evaluation function by taking a weighted average value of said first and second square errors by weighting coefficients; and setting said weighting coefficients to respective preset values, based on said speech decision value, depending on the speech segment and the non-speech segment, to calculate said evaluation function.

12. The code converting apparatus according to claim 8, wherein said corrected optimum gain is based on the long-term average value of said optimum gain.

13. The code converting apparatus according to claim 8, wherein the gain minimizing the distance between the second speech signal generated by the information obtained from said second code sequence and said first speech signal is found as said optimum gain.

14. The code converting apparatus according to claim 8, further comprising:

a speech/non-speech discriminating circuit for discriminating a speech decision value, discriminating a speech segment/non-speech segment, based on said first linear prediction coefficient;

said gain encoding circuit finding the gain information in said second code sequence, using an evaluation function which will decrease temporal variations of the gain in said second code sequence, when said speech decision value indicates the non-speech segment.

15. A computer program product in a medium used by a computer that composes a code converting apparatus for converting a first code sequence, conforming to a first system, into a second code sequence conforming to a second system, comprising a program for causing said computer to execute:

(a) the processing of acquiring first linear prediction coefficient and first information on an excitation signal from said first code sequence and actuating a filter having said first linear prediction coefficient with the excitation signal obtained from said first information to generate a first speech signal;

(b) the processing of calculating an optimum gain based on a second speech signal generated by second information obtained from a second code sequence, and based on said first speech signal;

(c) the processing of correcting said optimum gain to generate corrected optimum gain; and (d) the processing of finding the gain information in said second code sequence based on said corrected optimum gain, said optimum gain and on a gain read out from a gain codebook for said second system.

16. The computer program product according to claim 15, further comprising a program to cause said computer to execute the processing of finding the gain information in said second code sequence by calculating a first square error from the corrected optimum gain and from the gain read out from said gain codebook:

calculating a second square error from said optimum gain and from the gain read out from said gain codebook; and selecting a gain minimizing an evaluation function which is based on said first square error and said second square error from said gain codebook to find the gain information in said second code sequence.

17. The computer program product according to claim 16, wherein said evaluation function is composed of said first square error, said second square error and weighting coefficients.

18. The computer program product according to claim 16, further comprising a program to cause the computer to execute:

the processing of outputting a speech decision value, discriminating the speech segment/non-speech segment, based on said first linear prediction coefficient; and the processing of finding said evaluation function by taking a weighted average value of said first and second square errors by weighting coefficients, and setting said weighting coefficients to respective preset values, based on said speech decision value, depending on the speech segment and the non-speech segment, to calculate said evaluation function.

19. The computer program product according to claim 15, wherein said corrected optimum gain is based on a long-term average value of said optimum gain.

20. The computer program product according to claim 15, wherein the gain minimizing the distance between the second speech signal generated by the information obtained from said second code sequence and said first speech signal is found as said optimum gain.

21. The computer program product according to claim 15, further comprising a program to cause the computer to execute:

the processing of outputting a speech decision value, discriminating speech segment/non-speech segment, based on said first linear prediction coefficient; and the processing of finding the gain information in said second code sequence, using an evaluation function which will decrease temporal variations of the gain in said second code sequence, when said speech decision value indicates the non-speech segment.

22. A recording medium that may be read out by a computer, said recording medium having recorded thereon said program as defined in claim 15.

* * * * *